US011407229B2

(12) United States Patent
Panshin et al.

(10) Patent No.: US 11,407,229 B2
(45) Date of Patent: Aug. 9, 2022

(54) LOGIC CIRCUITRY PACKAGE

(71) Applicant: HEWLETT-PACKARD DEVELOPMENT COMPANY, L.P., Spring, TX (US)

(72) Inventors: Stephen D. Panshin, Corvallis, OR (US); Jefferson P. Ward, Vancouver, WA (US); James Michael Gardner, Corvallis, OR (US); Anthony D. Studer, Corvallis, OR (US); David N. Olsen, Corvallis, OR (US); Quinton B. Weaver, Corvallis, OR (US); David Owen Roethig, Vancouver, WA (US); Christopher Hans Bakker, Corvallis, OR (US); David B. Novak, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 42 days.

(21) Appl. No.: 16/769,923

(22) PCT Filed: Oct. 25, 2019

(86) PCT No.: PCT/US2019/058116

§ 371 (c)(1),
(2) Date: Jun. 4, 2020

(87) PCT Pub. No.: WO2021/080607

PCT Pub. Date: Apr. 29, 2021

(65) Prior Publication Data

US 2021/0402784 A1 Dec. 30, 2021

(51) Int. Cl.
*B41J 2/175* (2006.01)

(52) U.S. Cl.
CPC ..... *B41J 2/17546* (2013.01); *B41J 2/17526* (2013.01)

(58) Field of Classification Search
CPC ..... B41J 2/17546; B41J 2/17526
(Continued)

(56) References Cited

U.S. PATENT DOCUMENTS 4,074,284 A 2/1978 Dexter et al.
4,506,276 A 3/1985 Kyser et al.
(Continued)

FOREIGN PATENT DOCUMENTS

AU 2014202104 A1 5/2014
CA 2507422 A1 1/2002
(Continued)

OTHER PUBLICATIONS

Arnostech, "Thermal Inkjet Printers," http://www.arnostech.com/machines/coding-systems/thermal-inkjet-printers/, retrieved Jul. 1, 2019, 3 pgs.
(Continued)

*Primary Examiner* — Kristal Feggins
*Assistant Examiner* — Alexander D Shenderov
(74) *Attorney, Agent, or Firm* — Dicke Billig & Czaja PLLC

(57) ABSTRACT

A logic circuitry package for a replaceable print apparatus component includes an interface to communicate with a print apparatus logic circuit, and a logic circuit having a communication address to communicate with the print apparatus logic circuit. The logic circuit is configured to detect, via the interface, communications that include an other communication address. The logic circuit is configured to respond, via the interface, to a command series directed to the logic circuit that include the communication address of the logic circuit, based on the detected communications.

23 Claims, 17 Drawing Sheets

(58) Field of Classification Search
USPC ..... 347/6
See application file for complete search history.

(56) References Cited

U.S. PATENT DOCUMENTS

| | | | |
|---|---|---|---|
| 4,639,738 | A | 1/1987 | Young et al. |
| 4,734,787 | A | 3/1988 | Hayashi |
| 5,001,596 | A | 3/1991 | Hart |
| 5,045,811 | A | 9/1991 | Lewis |
| 5,079,570 | A | 1/1992 | Mohr et al. |
| 5,142,909 | A | 9/1992 | Baughman |
| 5,329,254 | A | 7/1994 | Takano |
| 5,438,351 | A | 8/1995 | Trenchard et al. |
| 5,471,176 | A | 11/1995 | James et al. |
| 5,561,691 | A | 10/1996 | Weinraub |
| 5,583,544 | A | 12/1996 | Stamer et al. |
| 5,680,960 | A | 10/1997 | Keyes et al. |
| 5,682,184 | A | 10/1997 | Stephany et al. |
| 5,699,091 | A | 12/1997 | Bullock et al. |
| 5,731,824 | A | 3/1998 | Kneezel et al. |
| 5,751,323 | A | 5/1998 | Swanson |
| 5,757,406 | A | 5/1998 | Kaplinsky et al. |
| 5,777,646 | A | 7/1998 | Barinaga et al. |
| 5,788,388 | A | 8/1998 | Cowger et al. |
| 5,861,780 | A | 1/1999 | Fukuda |
| 5,975,688 | A | 11/1999 | Kanaya et al. |
| 6,068,363 | A | 5/2000 | Saito |
| 6,098,457 | A | 8/2000 | Poole |
| 6,151,039 | A | 11/2000 | Hmelar et al. |
| 6,164,766 | A | 12/2000 | Erickson |
| 6,175,929 | B1 | 1/2001 | Hsu et al. |
| 6,219,933 | B1 | 4/2001 | Taniguchi et al. |
| 6,299,273 | B1 | 10/2001 | Anderson et al. |
| 6,312,074 | B1 | 11/2001 | Walker |
| 6,341,853 | B1 | 1/2002 | Scheffelin et al. |
| 6,386,693 | B1 | 5/2002 | Michele |
| 6,402,299 | B1 | 6/2002 | DeMeerleer |
| 6,412,901 | B2 | 7/2002 | Su et al. |
| 6,431,670 | B1 | 8/2002 | Schantz et al. |
| 6,456,802 | B1 | 9/2002 | Phillips |
| 6,457,355 | B1 | 10/2002 | Philipp |
| 6,494,553 | B1 | 12/2002 | Donahue et al. |
| 6,494,568 | B2 | 12/2002 | Hou et al. |
| 6,598,963 | B1 | 7/2003 | Yamamoto et al. |
| 6,641,240 | B2 | 11/2003 | Hsu et al. |
| 6,641,243 | B2 | 11/2003 | Anderson et al. |
| 6,648,434 | B2 | 11/2003 | Walker et al. |
| 6,685,290 | B1 | 2/2004 | Farr et al. |
| 6,736,497 | B2 | 5/2004 | Jung |
| 6,796,644 | B1 | 9/2004 | Anderson, Jr. et al. |
| 6,802,581 | B2 | 10/2004 | Hasseler et al. |
| 6,802,602 | B2 | 10/2004 | Sakai et al. |
| 6,811,250 | B2 | 11/2004 | Buchanan et al. |
| 6,902,256 | B2 | 6/2005 | Anderson et al. |
| 6,908,179 | B2 | 6/2005 | Pan et al. |
| 6,959,599 | B2 | 11/2005 | Feldstein et al. |
| 6,966,222 | B2 | 11/2005 | Carson et al. |
| 6,969,137 | B2 | 11/2005 | Maeda |
| 7,039,734 | B2 | 5/2006 | Sun et al. |
| 7,077,506 | B2 | 7/2006 | Chen |
| 7,171,323 | B2 | 1/2007 | Shipton et al. |
| 7,240,130 | B2 | 7/2007 | Larson |
| 7,260,662 | B2 | 8/2007 | Moriwaki et al. |
| 7,328,115 | B2 | 2/2008 | Shipton et al. |
| 7,380,042 | B2 | 5/2008 | Wang et al. |
| 7,458,656 | B2 | 12/2008 | Smith |
| 7,533,960 | B2 | 5/2009 | Yasuda et al. |
| 7,547,082 | B2 | 6/2009 | Lee et al. |
| 7,630,304 | B2 | 12/2009 | Larson et al. |
| 7,686,423 | B2 | 3/2010 | Sato et al. |
| 7,740,347 | B2 | 6/2010 | Silverbrook et al. |
| 7,775,638 | B2 | 8/2010 | Hirosawa et al. |
| 7,802,857 | B2 | 9/2010 | Imai |
| 7,841,712 | B2 | 11/2010 | Muyskens et al. |
| 7,886,197 | B2 | 2/2011 | Wegman |
| 7,890,690 | B2 | 2/2011 | Naderi et al. |
| 7,970,042 | B2 | 6/2011 | Lexmark |
| 8,040,215 | B2 | 10/2011 | Zakriti |
| 8,161,224 | B2 | 4/2012 | Laurencin et al. |
| 8,215,018 | B2 | 7/2012 | Morita et al. |
| 8,220,910 | B2 | 7/2012 | Wanibe |
| 8,224,602 | B2 | 7/2012 | Lory et al. |
| 8,289,788 | B2 | 10/2012 | Asauchi |
| 8,331,581 | B2 | 12/2012 | Pennock |
| 8,348,377 | B2 | 1/2013 | Asauchi |
| 8,350,628 | B1 | 1/2013 | George et al. |
| 8,364,859 | B2 | 1/2013 | Sato |
| 8,386,657 | B2 | 2/2013 | Adkins et al. |
| 8,393,718 | B2 | 3/2013 | Kida et al. |
| 8,393,721 | B2 | 3/2013 | Katoh et al. |
| 8,429,437 | B2 | 4/2013 | Asauchi |
| 8,432,421 | B2 | 4/2013 | Muraki et al. |
| 8,438,919 | B2 | 5/2013 | Phillips et al. |
| 8,454,137 | B2 | 6/2013 | Price et al. |
| 8,556,394 | B2 | 10/2013 | Chen |
| 8,558,577 | B1 | 10/2013 | Soriano Fosas et al. |
| 8,562,091 | B2 | 10/2013 | Sabanovic et al. |
| 8,591,012 | B2 | 11/2013 | Yoshino et al. |
| 8,608,276 | B2 | 12/2013 | Oohashi et al. |
| 8,621,116 | B2 | 12/2013 | Fister et al. |
| 8,651,614 | B2 | 2/2014 | Sakamoto et al. |
| 8,651,643 | B2 | 2/2014 | Harvey et al. |
| 8,721,059 | B2 | 5/2014 | Kodama et al. |
| 8,721,203 | B2 | 5/2014 | Ehrhardt, Jr. |
| 8,752,943 | B2 | 6/2014 | Hirano et al. |
| 8,864,277 | B2 | 10/2014 | Rice et al. |
| 8,876,257 | B2 | 11/2014 | Harada et al. |
| 8,888,207 | B2 | 11/2014 | Furness, III et al. |
| 8,892,798 | B2 | 11/2014 | Tailliet et al. |
| 8,898,358 | B2 | 11/2014 | DeCesaris et al. |
| 8,978,487 | B2 | 3/2015 | Fergusson et al. |
| 8,990,467 | B2 | 3/2015 | Saito |
| 9,079,414 | B2 | 7/2015 | Lester et al. |
| 9,108,448 | B1 | 8/2015 | Bergstedt |
| 9,132,656 | B2 | 9/2015 | Nicholson, III et al. |
| 9,137,093 | B1 | 9/2015 | Abraham et al. |
| 9,176,921 | B2 | 11/2015 | Fister et al. |
| 9,194,734 | B2 | 11/2015 | Mehrer |
| 9,213,396 | B1 | 12/2015 | Booth et al. |
| 9,213,927 | B1 | 12/2015 | Ahne et al. |
| 9,254,661 | B2 | 2/2016 | Otaka et al. |
| 9,298,908 | B1 | 3/2016 | Booth et al. |
| 9,370,934 | B2 | 6/2016 | Asauchi et al. |
| 9,400,204 | B2 | 7/2016 | Schoenberg |
| 9,413,356 | B1 | 8/2016 | McKinley |
| 9,413,359 | B2 | 8/2016 | Stirk |
| 9,454,504 | B2 | 9/2016 | Evans |
| 9,483,003 | B2 | 11/2016 | Thacker, III |
| 9,487,017 | B2 | 11/2016 | Ge et al. |
| 9,496,884 | B1 | 11/2016 | Azenkot et al. |
| 9,511,596 | B2 | 12/2016 | Anderson et al. |
| 9,561,662 | B2 | 2/2017 | Ward et al. |
| 9,582,443 | B1 | 2/2017 | Switzer et al. |
| 9,599,500 | B2 | 3/2017 | Ge et al. |
| 9,619,663 | B2 | 4/2017 | Refstrup |
| 9,671,820 | B2 | 6/2017 | Maruyama et al. |
| 9,734,121 | B2 | 8/2017 | Pitigoi-Aron et al. |
| 9,738,087 | B2 | 8/2017 | Kato et al. |
| 9,746,799 | B2 | 8/2017 | Jeran |
| 9,770,914 | B2 | 9/2017 | Harvey et al. |
| 9,776,412 | B2 | 10/2017 | Ge et al. |
| 9,789,697 | B1 | 10/2017 | Knierim et al. |
| 9,796,178 | B2 | 10/2017 | Maxfield |
| 9,811,480 | B2 | 11/2017 | Christian et al. |
| 9,852,282 | B2 | 12/2017 | Jeran et al. |
| 9,876,794 | B2 | 1/2018 | Adkins et al. |
| 9,895,917 | B2 | 2/2018 | Corvese et al. |
| 9,914,306 | B2 | 3/2018 | Jeran |
| 9,922,276 | B2 | 3/2018 | Fister et al. |
| 9,994,036 | B2 | 6/2018 | Angulo Navarro et al. |
| 10,031,882 | B2 | 7/2018 | Srivastava et al. |
| 10,052,878 | B2 | 8/2018 | Benneton |
| 10,107,667 | B2 | 10/2018 | Cumbie et al. |
| 10,146,608 | B2 | 12/2018 | Giovannini et al. |

(56) References Cited

U.S. PATENT DOCUMENTS 10,155,379 B2 12/2018 Ng et al.
10,214,018 B2 2/2019 Nozawa et al.
10,214,019 B2 2/2019 Campbell-Brown et al.
10,259,230 B2 4/2019 Asauchi
10,279,594 B2 5/2019 Horade
10,338,838 B2 7/2019 Olarig
10,452,582 B2 10/2019 Hershman et al.
10,471,725 B2 11/2019 Esterberg et al.
10,875,318 B1 12/2020 Gardner et al.
10,894,423 B2 1/2021 Gardner et al.
11,034,157 B2 6/2021 Gardner et al.
2001/0029554 A1 10/2001 Namba
2001/0033316 A1 10/2001 Eida
2002/0012016 A1 1/2002 Wilson et al.
2002/0012616 A1 1/2002 Zhou et al.
2002/0033855 A1 3/2002 Kubota et al.
2002/0109761 A1 8/2002 Shimizu et al.
2002/0129650 A1 9/2002 Zimmermann
2002/0154181 A1 10/2002 Kubota et al.
2003/0009595 A1 1/2003 Collins
2003/0018300 A1 1/2003 Duchon et al.
2003/0071862 A1 4/2003 Tsukada et al.
2003/0202024 A1 10/2003 Corrigan
2004/0021711 A1 2/2004 Hasseler
2004/0036733 A1 2/2004 Kubota et al.
2004/0085382 A1 5/2004 Kosugi et al.
2004/0155913 A1 8/2004 Kosugi et al.
2004/0252146 A1 12/2004 Naka et al.
2005/0010910 A1 1/2005 Lindhorst et al.
2005/0093910 A1 5/2005 Im
2005/0125105 A1 6/2005 Halstead et al.
2005/0126282 A1 6/2005 Maatuk
2005/0185595 A1 8/2005 Lee
2005/0229699 A1 10/2005 Chai et al.
2006/0007253 A1 1/2006 Kosugi
2006/0007295 A1 1/2006 Ueda
2006/0072952 A1 4/2006 Walmsley
2006/0110199 A1 5/2006 Walmsley et al.
2006/0181583 A1 8/2006 Usuda
2006/0181719 A1 8/2006 Aoki et al.
2006/0221386 A1 10/2006 Brooks et al.
2006/0244795 A1 11/2006 Hayasaki et al.
2006/0268030 A1 11/2006 Walmsley et al.
2006/0274103 A1 12/2006 Kim
2006/0290723 A1 12/2006 Jeong et al.
2007/0024650 A1 2/2007 Reinten et al.
2007/0068249 A1 3/2007 Eguchi et al.
2007/0088816 A1 4/2007 Hrustemovic et al.
2007/0115307 A1 5/2007 Smith
2007/0146409 A1 6/2007 Kubota et al.
2007/0247497 A1 10/2007 Buchanan et al.
2008/0024555 A1 1/2008 Kimura
2008/0041152 A1 2/2008 Schoenberg
2008/0107151 A1 5/2008 Khadkikar et al.
2008/0129779 A1 6/2008 Walmsley et al.
2008/0143476 A1 6/2008 Cheung et al.
2008/0165232 A1 7/2008 Yuen
2008/0192074 A1 8/2008 Dubois et al.
2008/0211838 A1 9/2008 Zhang
2008/0246626 A1 10/2008 Sheafor et al.
2008/0298455 A1 12/2008 Ilia et al.
2008/0307134 A1 12/2008 Geissler et al.
2009/0013779 A1 1/2009 Usui
2009/0021766 A1 1/2009 Yamazaki
2009/0177823 A1 7/2009 Chao
2009/0179678 A1 7/2009 Hardin
2009/0290005 A1 11/2009 Wanibe
2009/0309941 A1 12/2009 Price
2010/0082271 A1 4/2010 McCann et al.
2010/0138745 A1 6/2010 McNamara
2010/0205350 A1 8/2010 Bryant-Rich
2010/0220128 A1 9/2010 Zaba
2010/0248208 A1 9/2010 Okubo et al.
2010/0254202 A1 10/2010 Asauchi
2010/0257327 A1 10/2010 Kosugi
2010/0306431 A1 12/2010 Adkins et al.
2011/0009938 A1 1/2011 Dowling
2011/0029705 A1 2/2011 Evans
2011/0050793 A1 3/2011 Kumagai et al.
2011/0087914 A1 4/2011 Files et al.
2011/0113171 A1 5/2011 Radhakrishnan et al.
2011/0131441 A1 6/2011 Asauchi
2011/0279530 A1 11/2011 Love
2011/0285027 A1 11/2011 Lee
2012/0128379 A1 5/2012 Takeda
2012/0243559 A1 9/2012 Pan et al.
2012/0284429 A1 11/2012 Adkins et al.
2012/0299989 A1 11/2012 Prothon
2013/0018513 A1 1/2013 Metselaar
2013/0054933 A1* 2/2013 Fister ..... B41J 2/17546 711/203
2013/0067015 A1 3/2013 Vasters
2013/0067016 A1 3/2013 Adkins
2013/0155142 A1 6/2013 Browning et al.
2013/0250024 A1 9/2013 Kakishima
2013/0295245 A1 11/2013 Gardner
2014/0040517 A1 2/2014 Fister et al.
2014/0095750 A1 4/2014 Tailliet
2014/0164660 A1 6/2014 DeCesaris et al.
2014/0211241 A1 7/2014 Rice et al.
2014/0260520 A1 9/2014 Schoenberg
2014/0265049 A1 9/2014 Burris et al.
2014/0337553 A1 11/2014 Du et al.
2014/0351469 A1 11/2014 Fister et al.
2014/0354729 A1 12/2014 Vanbrocklin et al.
2014/0372652 A1 12/2014 Shu
2014/0375321 A1 12/2014 Ikeya
2014/0375730 A1 12/2014 Campbell-Brown
2015/0028671 A1 1/2015 Ragaini et al.
2015/0052996 A1 2/2015 Niemann
2015/0074304 A1 3/2015 Adkins et al.
2015/0089630 A1 3/2015 Lee
2015/0239254 A1 8/2015 Muyskens et al.
2015/0285526 A1 10/2015 Smith et al.
2015/0343792 A1 12/2015 Refstrup
2015/0378409 A1 12/2015 Dunstan
2016/0055402 A1 2/2016 Fister et al.
2016/0098359 A1 4/2016 Adkins et al.
2016/0110535 A1 4/2016 Booth et al.
2016/0114590 A1 4/2016 Arpin
2016/0207323 A1 7/2016 Ward et al.
2016/0279962 A1 9/2016 Ishida et al.
2016/0357691 A1 12/2016 Ahne
2016/0364305 A1 12/2016 Pitigou-Aron
2016/0368273 A1 12/2016 Ishikawa
2017/0032135 A1 2/2017 Refstrup
2017/0050383 A1 2/2017 Bell et al.
2017/0100941 A1 4/2017 Kuribayashi
2017/0144448 A1 5/2017 Smith
2017/0157929 A1 6/2017 Yokoo et al.
2017/0168976 A1 6/2017 Yost et al.
2017/0169623 A1 6/2017 Chen et al.
2017/0182786 A1 6/2017 Angulo Navarro
2017/0189011 A1 7/2017 Stone et al.
2017/0194913 A1 7/2017 Wilson et al.
2017/0230540 A1 8/2017 Sasaki
2017/0330449 A1 11/2017 Lunardhi
2018/0050537 A1 2/2018 Bakker et al.
2018/0100753 A1 4/2018 Cumbie et al.
2018/0143935 A1 5/2018 Cox
2018/0157943 A1 6/2018 Fister et al.
2018/0162137 A1 6/2018 Van Brocklin et al.
2018/0212593 A1 7/2018 Usuda
2018/0264808 A1 9/2018 Bakker et al.
2018/0281394 A1 10/2018 Horade
2018/0281438 A1 10/2018 Horade
2018/0290457 A1 10/2018 Ge et al.
2018/0302110 A1 10/2018 Solan
2018/0304640 A1 10/2018 Horne
2019/0004991 A1 1/2019 Foust
2019/0011306 A1 1/2019 Cumbie et al.
2019/0012663 A1 1/2019 Masters
2019/0013731 A1 1/2019 Gritti
2019/0023020 A1 1/2019 Anderson

(56) References Cited

U.S. PATENT DOCUMENTS

| | | | |
|---|---|---|---|
| 2019/0061347 | A1 | 2/2019 | Bakker et al. |
| 2019/0064408 | A1 | 2/2019 | Smit |
| 2019/0097785 | A1 | 3/2019 | Elenes |
| 2019/0111694 | A1 | 4/2019 | Cumbie et al. |
| 2019/0111695 | A1 | 4/2019 | Anderson et al. |
| 2019/0111696 | A1 | 4/2019 | Anderson et al. |
| 2019/0118527 | A1 | 4/2019 | Anderson et al. |
| 2019/0126631 | A1 | 5/2019 | Anderson et al. |
| 2019/0137316 | A1 | 5/2019 | Anderson et al. |
| 2019/0138484 | A1 | 5/2019 | De Santiago Dominguez et al. |
| 2019/0217628 | A1 | 7/2019 | Horade et al. |
| 2019/0226930 | A1 | 7/2019 | Cumbie et al. |
| 2019/0240985 | A1 | 8/2019 | Ge et al. |
| 2020/0159689 | A1 | 5/2020 | Koshisaka et al. |
| 2021/0334392 | A1 | 10/2021 | Panshin et al. |

FOREIGN PATENT DOCUMENTS

| | | | |
|---|---|---|---|
| CA | 2896345 | A1 | 7/2014 |
| CN | 2603934 | Y | 2/2004 |
| CN | 2734479 | Y | 10/2005 |
| CN | 201761148 | U | 3/2011 |
| CN | 102231054 | A | 11/2011 |
| CN | 203651218 | U | 6/2014 |
| CN | 102736627 | B | 12/2014 |
| CN | 103879149 | B | 6/2015 |
| CN | 105760318 | A | 7/2016 |
| CN | 107209743 | A | 9/2017 |
| CN | 108819486 | A | 11/2018 |
| CN | 209014461 | U | 6/2019 |
| DE | 3712699 | A1 | 11/1988 |
| EP | 0015954 | B1 | 6/1984 |
| EP | 0720916 | A2 | 7/1996 |
| EP | 0994779 | A1 | 4/2000 |
| EP | 1164022 | A2 | 12/2001 |
| EP | 1238811 | A1 | 9/2002 |
| EP | 1285764 | A1 | 2/2003 |
| EP | 1314565 | A2 | 5/2003 |
| EP | 1389531 | A1 | 2/2004 |
| EP | 1524120 | A2 | 4/2005 |
| EP | 1800872 | A1 | 6/2007 |
| EP | 1839872 | A1 | 10/2007 |
| EP | 2237163 | A1 | 10/2010 |
| EP | 2385468 | A1 | 11/2011 |
| EP | 2854063 | A1 | 4/2015 |
| EP | 3161585 | A1 | 5/2017 |
| EP | 3208736 | A1 | 8/2017 |
| GB | 2519181 | A | 4/2015 |
| JP | H04220353 | A | 8/1992 |
| JP | 2001292133 | A | 10/2001 |
| JP | 2002026471 | A | 1/2002 |
| JP | 2003326726 | A | 11/2003 |
| JP | 2005262458 | A | 9/2005 |
| JP | 2009258604 | A | 11/2009 |
| JP | 2010079199 | A | 4/2010 |
| JP | 2011113336 | A | 6/2011 |
| JP | 2012063770 | A | 3/2012 |
| JP | 2013197677 | A | 9/2013 |
| JP | 5644052 | B2 | 12/2014 |
| JP | 2014534917 | A | 12/2014 |
| JP | 2016185664 | A | 10/2016 |
| JP | 2017196842 | A | 11/2017 |
| JP | 2018049141 | A | 3/2018 |
| JP | 2018136774 | A | 8/2018 |
| JP | 2018161785 | A | 10/2018 |
| JP | 2018531394 | A | 10/2018 |
| KR | 20080003539 | A | 1/2008 |
| KR | 101785051 | B1 | 10/2017 |
| TW | 200707209 | A | 2/2007 |
| TW | 201202948 | A | 1/2012 |
| TW | 201546620 | A | 12/2015 |
| WO | WO-2007107957 | A1 | 9/2007 |
| WO | WO-2008117194 | A1 | 10/2008 |
| WO | WO-2009145774 | A1 | 12/2009 |
| WO | WO-2012020443 | A8 | 2/2012 |
| WO | WO-2012054050 | A1 | 4/2012 |
| WO | WO-2012057755 | A1 | 5/2012 |
| WO | WO-2013048430 | A1 | 4/2013 |
| WO | WO-2015116092 | A1 | 8/2015 |
| WO | WO-2016061480 | A2 | 4/2016 |
| WO | WO-2016114759 | A1 | 7/2016 |
| WO | WO-2016130157 | A1 | 8/2016 |
| WO | WO-2017074334 | A1 | 5/2017 |
| WO | WO-2017074342 | A1 | 5/2017 |
| WO | WO-2017174363 | A1 | 10/2017 |
| WO | WO-2017184147 | A1 | 10/2017 |
| WO | WO-2017189009 | A1 | 11/2017 |
| WO | WO-2017189010 | A1 | 11/2017 |
| WO | WO-2017189011 | A1 | 11/2017 |
| WO | WO-2017189013 | A1 | 11/2017 |
| WO | WO-2018017066 | A1 | 1/2018 |
| WO | WO-2018022038 | A1 | 2/2018 |
| WO | WO-2018186847 | A1 | 10/2018 |
| WO | WO-2018199886 | A1 | 11/2018 |
| WO | WO-2018199891 | A1 | 11/2018 |
| WO | WO-2018199895 | A1 | 11/2018 |
| WO | WO-2018217185 | A1 | 11/2018 |
| WO | WO-2019017963 | A1 | 1/2019 |
| WO | WO-2019078834 | A1 | 4/2019 |
| WO | WO-2019078835 | A1 | 4/2019 |
| WO | WO-2019078839 | A1 | 4/2019 |
| WO | WO-2019078840 | A1 | 4/2019 |
| WO | WO-2019078843 | A1 | 4/2019 |
| WO | WO-2019078844 | A1 | 4/2019 |
| WO | WO-2019078845 | A1 | 4/2019 |

OTHER PUBLICATIONS

Epson, "Epson Provides the Best Inks for the Job," https://www.epson.co.nz/microsite/excellence/inks_why.asp, retrieved Jul. 1, 2019, 3 pgs.

Platform Development Team, "Development of the HP DeskJet 1200C Print Cartridge Platform," Hewlett-Packard Journal, Feb. 1994, pp. 46-54.

International Searching Authority, "International Search Report and Written Opinion," issued in connection with PCT/US2019/026159, dated Aug. 13, 2019, 15 pgs.

International Searching Authority, "International Search Report and Written Opinion," issued in connection with PCT/US2018/063624, dated Aug. 23, 2019, 13 pgs.

International Searching Authority, "International Search Report and Written Opinion," issued in connection with PCT/US2018/063630, dated Aug. 22, 2019, 15 pgs.

International Searching Authority, "International Search Report and Written Opinion," issued in connection with PCT/US2018/063633, dated Jul. 23, 2019, 12 pgs.

International Searching Authority, "International Search Report and Written Opinion," issued in connection with PCT/US2018/063638, dated Aug. 26, 2019, 13 pgs.

International Searching Authority, "International Search Report and Written Opinion," issued in connection with PCT/US2018/063643, dated Aug. 20, 2019, 13 pgs.

International Searching Authority, "International Search Report and Written Opinion," issued in connection with PCT/US2019/017511, dated Jul. 25, 2019, 12 pgs.

International Searching Authority, "International Search Report and Written Opinion," issued in connection with PCT/US2019/026124, dated Aug. 26, 2019, 15 pgs.

International Searching Authority, "International Search Report and Written Opinion," issued in connection with PCT/US2019/026133, dated Aug. 26, 2019, 18 pgs.

International Searching Authority, "International Search Report and Written Opinion," issued in connection with PCT/US2019/026145, dated Sep. 5, 2019, 16 pgs.

International Searching Authority, "International Search Report and Written Opinion," issued in connection with PCT/US2019/026161, dated Aug. 26, 2019, 20 pgs.

International Searching Authority, "International Search Report and Written Opinion," issued in connection with PCT/US2018/063631, dated Aug. 23, 2019, 13 pgs.

(56) References Cited

OTHER PUBLICATIONS

Maxim Integrated Products, "1-to-8 I2C Bus Switches/Multiplexers with Bus Lock-Up Detection, Isolation, and Notification," Sep. 2008, 22 pgs.
NXP, "Introducing A10006 Secure Authenticator Tamper-Resistant Anti Counterfeit Solution", retreived Jul. 3, 2019, 29 pgs.
NXP B.V., "NXP 2-, 4-, and 8-Channel I2C/SMBus Muxes and Switches PCA954x," Jul. 2008, 4 pgs.
NXP Semiconductors N.V., "PCA9641: 2-Channel I2C-Bus Master Arbiter," Oct. 27, 2015, 55 pgs.
Laureto, John et al., "Open Source Multi-Head 3D Printer for Polymer-Metal Composite Component Manufacturing," Technologies, MDPI, 2017, 5 (2), pp. 36, 23 pgs.
NXP Semiconductors N.V., "PCA9547: 8-Channel I2C-Bus Multiplexer with Reset," Apr. 1, 2014, 34 pgs.
NXP Semiconductors N.V., "AN11593: How to Design in and Program the PCA9641 I2C Arbiter," Oct. 23, 2014, 22 pgs.
Reddit, "Use an Accelerometer to Measure Z wobble", retrieved Jul. 1, 2019, 3 pgs, https://www.reddit.com/r/Reprap/comments/6qsoyd/use_an_accelerometer_to_measure_z_wobble/.
Phillips Semiconductors, "The IC-Bus Specification", Version 2.1, Jan. 2000, 46 pgs.
United States Patent and Trademark Office, "Non-Final Office Action," issued in connection with U.S. Appl. No. 16/502,479, filed Dec. 11, 2019, 13 pgs.
United States Patent and Trademark Office, "Non-Final Office Action," issued in connection with U.S. Appl. No. 16/460,016, filed Sep. 12, 2019, 12 pgs.
United States Patent and Trademark Office, "Non-Final Office Action," issued in connection with U.S. Appl. No. 16/505,090, filed Sep. 10, 2019, 20 pgs.
United States Patent and Trademark Office, "Notice of Allowance," issued in connection with U.S. Appl. No. 16/502,479, filed Apr. 9, 2020, 9 pgs.
United States Patent and Trademark Office, "Notice of Allowance," issued in connection with U.S. Appl. No. 16/460,016, filed Mar. 25, 2020, 10 pgs.
United States Patent and Trademark Office, "Notice of Allowance," issued in connection with U.S. Appl. No. 16/505,090, filed Feb. 12, 2020, 9 pgs.
United States Patent and Trademark Office, "Notice of Allowance," issued in connection with U.S. Appl. No. 16/505,090, filed Oct. 22, 2019, 5 pgs.
United States Patent and Trademark Office, "Notice of Allowance," issued in connection with U.S. Appl. No. 16/728,207, filed Feb. 19, 2020, 19 pgs.
United States Patent and Trademark Office, "Restriction Requirement," issued in connection with U.S. Appl. No. 16/502,479, filed Aug. 15, 2019, 7 pgs.

* cited by examiner

| | | |
|---|---|---|
| FIRST REPLACEABLE PRINT APPARATUS COMPONENT 902(1) | OTHER REPLACEABLE PRINT APPARATUS COMPONENT 902(2) | FURTHER REPLACEABLE PRINT APPARATUS COMPONENT 902(3) |
| FIRST DEFAULT ADDRESS 904(1) | OTHER FIRST DEFAULT ADDRESS 904(2) | FURTHER FIRST DEFAULT ADDRESS 904(3) |
| SECOND DEFAULT ADDRESS 906(1) | SECOND DEFAULT ADDRESS 906(2) | SECOND DEFAULT ADDRESS 906(3) |
| THIRD/RECONFIGURED/ TEMPORARY ADDRESS 908(1) | OTHER THIRD/RECONFIGURED/ TEMPORARY ADDRESS 908(2) | FURTHER THIRD/RECONFIGURED/ TEMPORARY ADDRESS 908(3) |

Fig. 8

LOGIC CIRCUITRY PACKAGE

CROSS-REFERENCE TO RELATED APPLICATIONS

This application is a U.S. National Stage Application of PCT Application No. PCT/US2019/058116, filed Oct. 25, 2019, entitled "LOGIC CIRCUITRY PACKAGE."

BACKGROUND

Subcomponents of apparatus may communicate with one another in a number of ways. For example, Serial Peripheral Interface (SPI) protocol, Bluetooth Low Energy (BLE), Near Field Communications (NFC) or other types of digital or analog communications may be used.

Some two-dimensional (2D) and three-dimensional (3D) printing systems include one or more replaceable print apparatus components, such as print material containers (e.g., inkjet cartridges, toner cartridges, ink supplies, 3D printing agent supplies, build material supplies etc.), inkjet printhead assemblies, and the like. In some examples, logic circuitry associated with the replaceable print apparatus component(s) communicate with logic circuitry of the print apparatus in which they are installed, for example communicating information such as their identity, capabilities, status and the like. In further examples, print material containers may include circuitry to execute one or more monitoring functions such as print material level sensing.

BRIEF DESCRIPTION OF THE DRAWINGS

FIG. 8 illustrates a table of example address names for multiple replaceable print apparatus components.

DETAILED DESCRIPTION

Figure 1:
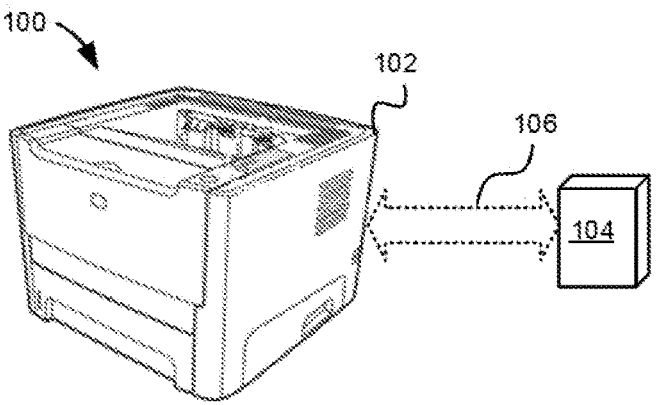
FIG. 1 illustrates one example of a printing system.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Some examples of applications described herein are in the context of print apparatus. Not all the examples, however, are limited to such applications, and at least some of the principles set out herein may be used in other contexts. The contents of other applications and patents cited in this disclosure are incorporated by reference.

In certain examples, Inter-integrated Circuit ($I^2C$, or I2C, which notation is adopted herein) protocol allows at least one 'master' integrated circuit (IC) to communicate with at least one 'slave' IC, for example via a bus. I2C, and other communications protocols, communicate data according to a clock period. For example, a voltage signal may be generated, where the value of the voltage is associated with data. For example, a voltage value above X volts may indicate a logic "1" whereas a voltage value below X volts may indicate a logic "0", where X is a predetermined numerical value. By generating an appropriate voltage in each of a series of clock periods, data can be communicated via a bus or another communication link.

Certain example print material containers have slave logic that utilize I2C communications, although in other examples, other forms of digital or analog communications could also be used. In the example of I2C communication, a master IC may generally be provided as part of the print apparatus (which may be referred to as the 'host') and a replaceable print apparatus component would comprise a 'slave' IC, although this need not be the case in all examples. There may be a plurality of slave ICs connected to an I2C communication link or bus (for example, containers of different colors of print agent). The slave IC(s) may include a processor to perform data operations before responding to requests from logic circuitry of the print system.

Communications between print apparatus and replaceable print apparatus components installed in the apparatus (and/or the respective logic circuitry thereof) may facilitate various functions. Logic circuitry within a print apparatus may receive information from logic circuitry associated with a replaceable print apparatus component via a communications interface, and/or may send commands to the replaceable print apparatus component logic circuitry, which may include commands to write data to a memory associated therewith, or to read data therefrom.

One example of logic circuitry associated with replaceable print apparatus components may include leader logic circuitry in a leader supply, and follower logic circuitry in each of a plurality of follower supplies. The leader logic circuitry includes a sensor installed within the fluid containing portion of the leader supply. The leader logic circuitry receives, via an I2C bus, a request from a print apparatus logic circuit to provide sensor information from the sensor. The leader logic circuitry provides a response to the request, via the I2C bus, to the print apparatus logic circuit. The follower logic circuitry for each of the follower supplies monitors the response from the leader logic circuitry (e.g., via the I2C bus), or receives the response from the leader logic circuitry (e.g., via another communication channel), and when the follower logic circuitry receives a request from the print apparatus logic circuit to provide sensor information, the follower logic circuitry responds with the same response or a similar response as the leader logic circuitry. In some examples, the leader logic circuitry pushes information to the follower logic circuitry, and the follower logic circuitry responds to the print apparatus logic circuit based on the pushed information.

Another example of logic circuitry associated with a replaceable print apparatus component may include a logic circuit that monitors an I2C bus for commands directed to I2C addresses other than its own address, as well as responses to those commands. In response to commands directed to the I2C address of the logic circuit, the logic circuit may mimic previously monitored responses (e.g., store and repeat), or provide a pre-stored response sequence upon detecting a specific command (e.g., a prime command). The logic circuit may also monitor the timing of responses from other components, and repeat that timing in responses provided by the logic circuit.

In at least some of the examples described below, a logic circuitry package is described. The logic circuitry package may be associated with a replaceable print apparatus component, for example being internally or externally affixed thereto, for example at least partially within the housing, and is adapted to communicate data with a print apparatus controller via a bus provided as part of the print apparatus.

A 'logic circuitry package' as the term is used herein refers to one logic circuit, or more logic circuits that may be interconnected or communicatively linked to each other. Where more than one logic circuit is provided, these may be encapsulated as a single unit, or may be separately encapsulated, or not encapsulated, or some combination thereof. The package may be arranged or provided on a single substrate or a plurality of substrates. In some examples, the package may be directly affixed to a cartridge wall. In some examples, the package may include an interface, for example including pads or pins. The package interface may be intended to connect to a communication interface of the print apparatus component that in turn connects to a print apparatus logic circuit, or the package interface may connect directly to the print apparatus logic circuit. Example packages may be configured to communicate via a serial bus interface. Where more than one logic circuit is provided, these logic circuits may be connected to each other or to the interface, to communicate through the same interface.

In some examples, each logic circuitry package is provided with at least one processor and memory. In one example, the logic circuitry package may be, or may function as, a microcontroller or secure microcontroller. In use, the logic circuitry package may be adhered to or integrated with the replaceable print apparatus component. A logic circuitry package may alternatively be referred to as a logic circuitry assembly, or simply as logic circuitry or processing circuitry.

In some examples, the logic circuitry package may respond to various types of requests (or commands) from a host (e.g., a print apparatus). A first type of request may include a request for data, for example identification and/or authentication information. A second type of request from a host may be a request to perform a physical action, such as performing at least one measurement. A third type of request may be a request for a data processing action. There may be additional types of requests.

In some examples, there may be more than one address associated with a particular logic circuitry package, which is used to address communications sent over a bus to identify the logic circuitry package which is the target of a communication (and therefore, in some examples, with a replaceable print apparatus component). In some examples, different requests are handled by different logic circuits of the package. In some examples, the different logic circuits may be associated with different addresses. For example, cryptographically authenticated communications may be associated with secure microcontroller functions and a first I2C address, while other communications may be associated with a sensor circuit and a second and/or reconfigured I2C address. In certain examples, these other communications via the second and/or reconfigured address can be scrambled or otherwise secured, not using the encryption key used for the secure microcontroller functions. In one example, the communications to the different address are processed and transmitted by a single logic circuit.

In some examples, a plurality of such logic circuitry packages (each of which may be associated with a different replaceable print apparatus component) may be connected to an I2C bus. In some examples, at least one address of the logic circuitry package may be an I2C compatible address (herein after, an I2C address), for example in accordance with an I2C protocol, to facilitate directing communications between master to slaves in accordance with the I2C protocol. In other examples, other forms of digital and/or analog communication can be used.

FIG. 1 illustrates one example of a printing system 100. The printing system 100 includes a print apparatus 102 in communication with logic circuitry associated with a replaceable print apparatus component 104 via a communications link 106. In some examples, the communications link 106 may include an I2C capable or compatible bus (herein after, an I2C bus). Although for clarity, the replaceable print apparatus component 104 is shown as external to the print apparatus 102, in some examples, the replaceable print apparatus component 104 may be housed within the print apparatus.

The replaceable print apparatus component 104 may include, for example, a print material container or cartridge (which could be a build material container for 3D printing, a liquid or dry toner container for 2D printing, or an ink or liquid print agent container for 2D or 3D printing), which may in some examples include a print head or other dispensing or transfer component. The replaceable print apparatus component 104 may, for example, contain a consumable resource of the print apparatus 102, or a component which is likely to have a lifespan which is less (in some examples, considerably less) than that of the print apparatus 102. Moreover, while a single replaceable print apparatus component 104 is shown in this example, in other examples, there may be a plurality of replaceable print apparatus components, for example including print agent containers of different colors, print heads (which may be integral to the containers), or the like. In other examples, the print apparatus components 104 could include service components, for example to be replaced by service personnel, examples of which could include print heads, toner process cartridges, or logic circuit package by itself to adhere to corresponding print apparatus component and communicate to a compatible print apparatus logic circuit.

Figure 2:
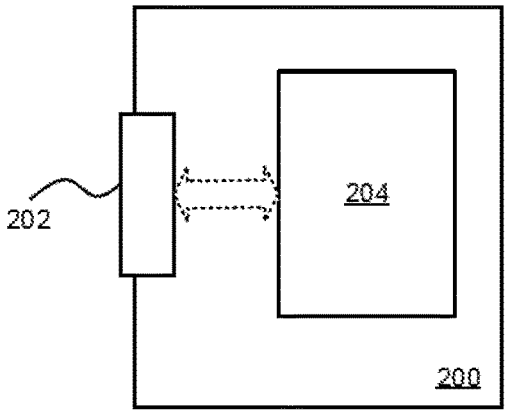
FIG. 2 illustrates one example of a replaceable print apparatus component.

FIG. 2 illustrates one example of a replaceable print apparatus component 200, which may provide the replaceable print apparatus component 104 of FIG. 1. The replaceable print apparatus component 200 includes a data interface 202 and a logic circuitry package 204. In use of the replaceable print apparatus component 200, the logic circuitry package 204 decodes data received via the data interface 202. The logic circuitry may perform other functions as set out below. The data interface 202 may include an I2C or other interface. In certain examples, the data interface 202 may be part of the same package as the logic circuitry package 204.

In some examples, the logic circuitry package 204 may be further configured to encode data for transmission via the data interface 202. In some examples, there may be more than one data interface 202 provided. In some examples, the logic circuitry package 204 may be arranged to act as a 'slave' in I2C communications.

Figure 3:
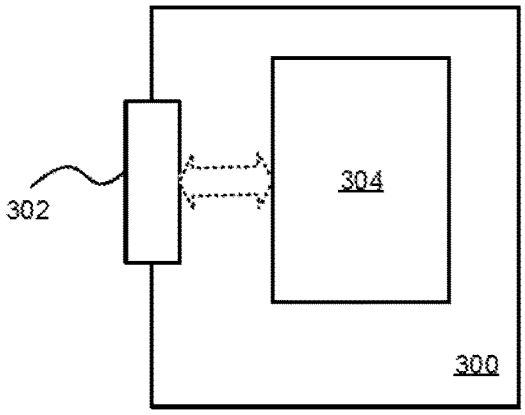
FIG. 3 illustrates one example of a print apparatus.

FIG. 3 illustrates one example of a print apparatus 300. The print apparatus 300 may provide the print apparatus 102 of FIG. 1. The print apparatus 300 may serve as a host for replaceable components. The print apparatus 300 includes an interface 302 for communicating with a replaceable print apparatus component and a controller 304. The controller 304 includes logic circuitry. In some examples, the interface 302 is an I2C interface.

In some examples, controller 304 may be configured to act as a host, or a master, in I2C communications. The controller 304 may generate and send commands to at least one replaceable print apparatus component 200, and may receive and decode responses received therefrom. In other examples the controller 304 may communicate with the logic circuitry package 204 using any form of digital or analog communication.

The print apparatus 102, 300 and replaceable print apparatus component 104, 200, and/or the logic circuitry thereof, may be manufactured and/or sold separately. In an example, a user may acquire a print apparatus 102, 300 and retain the apparatus 102, 300 for a number of years, whereas a plurality of replaceable print apparatus components 104, 200 may be purchased in those years, for example as print agent is used in creating a printed output. Therefore, there may be at least a degree of forwards and/or backwards compatibility between print apparatus 102, 300 and replaceable print apparatus components 104, 200. In many cases, this compatibility may be provided by the print apparatus 102, 300 as the replaceable print apparatus components 104, 200 may be relatively resource constrained in terms of their processing and/or memory capacity.

Figure 4A:
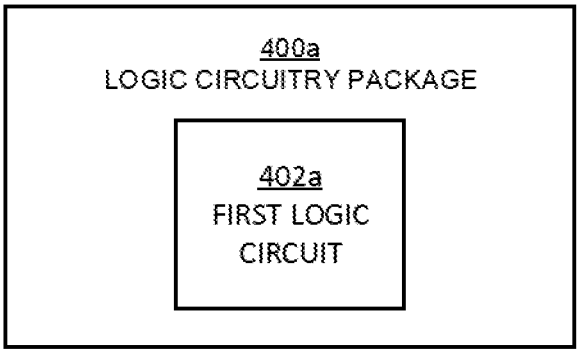
FIGS. 4A-4E illustrate examples of logic circuitry packages and processing circuitry.

FIG. 4A illustrates one example of a logic circuitry package 400*a*, which may for example provide the logic circuitry package 204 described in relation to FIG. 2. The logic circuitry package 400*a* may be associated with, or in some examples affixed to and/or be incorporated at least partially within, a replaceable print apparatus component 200.

In some examples, the logic circuitry package 400*a* is addressable via a first address and includes a first logic circuit 402*a*, wherein the first address is an I2C address for the first logic circuit 402*a*. In some examples, the first address may be configurable. In other examples, the first address is a fixed address (e.g., "hard-wired") intended to remain the same address during the lifetime of the first logic circuit 402*a*. The first address may be associated with the logic circuitry package 400*a* at and during the connection with the print apparatus logic circuit, outside of the time periods that are associated with a second address, as will be set out below. In example systems where a plurality of replaceable print apparatus components are to be connected to a single print apparatus, there may be a corresponding plurality of different first addresses. In certain examples, the first addresses can be considered standard I2C addresses for logic circuitry packages 400*a* or replaceable print components.

In some examples, the logic circuitry package 400*a* is also addressable via a second address. For example, the second address may be associated with different logic functions or, at least partially, with different data than the first address. In some examples, the second address may be associated with a different hardware logic circuit or a different virtual device than the first address. In some examples, the logic circuitry package 400*a* may include a memory to store the second address (in some examples in a volatile manner). In some examples, the memory may include a programmable address memory register for this purpose. The second address may have a default second address while the second address (memory) field may be reconfigurable to a different address. For example, the second address may be reconfigurable to a temporary address by a second address command, whereby it is set (back) to the default second address after or at each time period command to enable the second address. For example, the second address may be set to its default address in an out-of-reset state whereby, after each reset, it is reconfigurable to the temporary (i.e., reconfigured) address.

In some examples, the package 400*a* is configured such that, in response to a first command indicative of a first time period sent to the first address (and in some examples a task), the package 400*a* may respond in various ways. In some examples, the package 400*a* is configured such that it is accessible via at least one second address for the duration of the time period. Alternatively or additionally, in some examples, the package may perform a task, which may be the task specified in the first command. In other examples, the package may perform a different task. The first command may, for example, be sent by a host such as a print apparatus in which the logic circuitry package 400*a* (or an associated replaceable print apparatus component) is installed. As set out in greater detail below, the task may include obtaining a sensor reading.

Further communication may be directed to memory addresses to be used to request information associated with these memory addresses. The memory addresses may have a different configuration than the first and second address of the logic circuitry package 400*a*. For example, a host apparatus may request that a particular memory register is read out onto the bus by including the memory address in a read command. In other words, a host apparatus may have a knowledge and/or control of the arrangement of a memory. For example, there may be a plurality of memory registers and corresponding memory addresses associated with the second address. A particular register may be associated with a value, which may be static or reconfigurable. The host apparatus may request that the register be read out onto the bus by identifying that register using the memory address. In some examples, the registers may include any or any combination of address register(s), parameter register(s) (for example to store clock enable, clock source replacement, clock divider, and/or dither parameters), sensor identification register(s) (which may store an indication of a type of sensor), sensor reading register(s) (which may store values read or determined using a sensor), sensor number register(s) (which may store a number or count of sensors), version identity register(s), memory register(s) to store a count of clock cycles, memory register(s) to store a value indicative of a read/write history of the logic circuitry, or other registers.

Figure 4B:
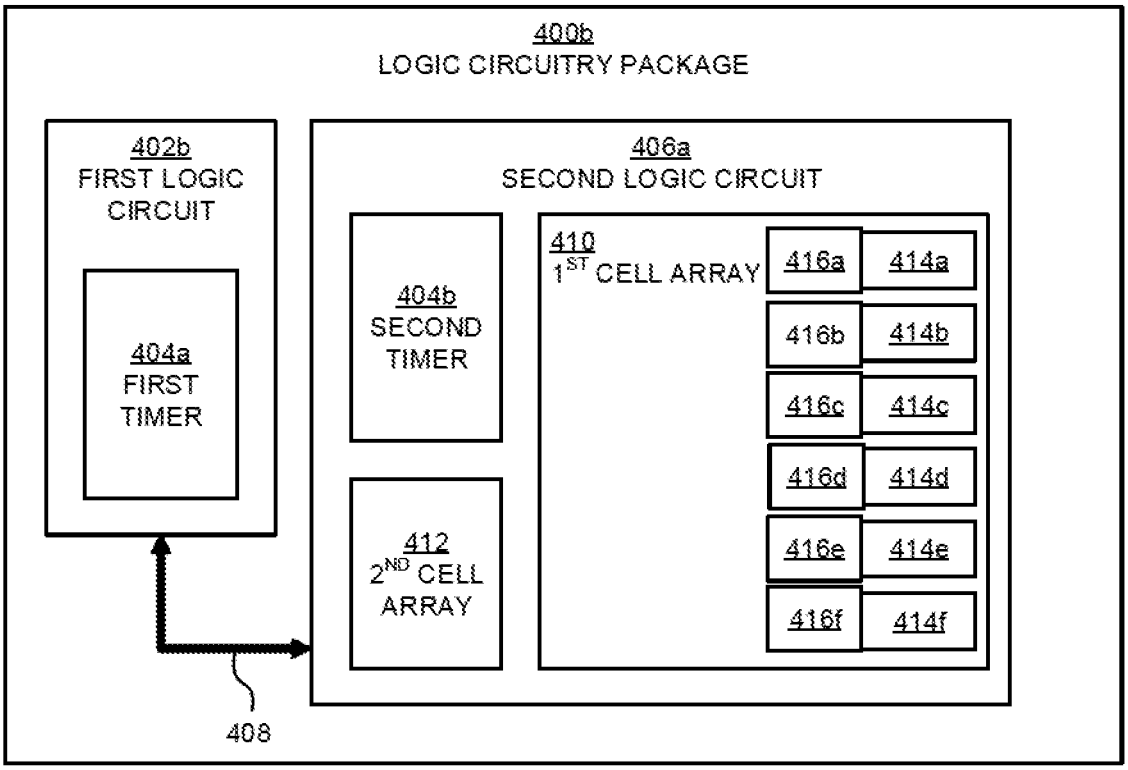

FIG. 4B illustrates another example of a logic circuitry package 400*b*. In this example, the package 400*b* includes a first logic circuit 402*b*, in this example, including a first timer 404*a*, and a second logic circuit 406*a*, in this example, including a second timer 404*b*. While in this example, each of the first and second logic circuits 402*b*, 406*a* include its own timer 404*a*, 404*b*, in other examples, they may share a timer or reference at least one external timer. In a further example, the first logic circuit 402*b* and the second logic circuit 406*a* are linked by a dedicated signal path 408.

In one example, the logic circuitry package 400*b* may receive a first command including two data fields. A first data field is a one byte data field setting a requested mode of operation. For example, there may be a plurality of predefined modes, such as a first mode, in which the logic circuitry package 400*b* is to ignore data traffic sent to the first address (for example, while performing a task), and a second mode in which the logic circuitry package 400*b* is to ignore data traffic sent to the first address and to transmit an enable signal to the second logic circuit 406*a*, as is further set out below. The first command may include additional fields, such as an address field and/or a request for acknowledgement.

The logic circuitry package 400*b* is configured to process the first command. If the first command cannot be complied with (for example, a command parameter is of an invalid length or value, or it is not possible to enable the second logic circuit 406*a*), the logic circuitry package 400*b* may generate an error code and output this to a communication link to be returned to host logic circuitry, for example in the print apparatus.

If, however, the first command is validly received and can be complied with, the logic circuitry package 400*b* measures the duration of the time period included in the first command, for example utilizing the timer 404*a*. In some examples, the timer 404*a* may include a digital "clock tree". In other examples, the timer 404*a* may include an RC circuit, a ring oscillator, or some other form of oscillator or timer. In this example, in response to receiving a valid first command, the first logic circuit 402*b* enables the second logic circuit 406*a* and effectively disables the first address, for example by tasking the first logic circuit 402*b* with a processing task. In some examples, enabling the second logic circuit 406*a* includes sending, by the first logic circuit 402*b*, an activation signal to the second logic circuit 406*a*. In other words, in this example, the logic circuitry package 400*b* is configured such that the second logic circuit 406*a* is selectively enabled by the first logic circuit 402*b*.

In this example, the second logic circuit 406*a* is enabled by the first logic circuit 402*b* sending a signal via a signal path 408, which may or may not be a dedicated signal path 408, that is, dedicated to enable the second logic circuit 406*a*. In one example, the first logic circuit 402*b* may have a dedicated contact pin or pad connected to the signal path 408, which links the first logic circuit 402*b* and the second logic circuit 406*a*. In a particular example, the dedicated contact pin or pad may be a General Purpose Input/Output (a GPIO) pin of the first logic circuit 402*b*. The contact pin/pad may serve as an enablement contact of the second logic circuit 406*a*.

In this example, the second logic circuit 406*a* is addressable via at least one second address. In some examples, when the second logic circuit 406*a* is activated or enabled, it may have an initial, or default, second address, which may be an I2C address or have some other address format. The second logic circuit 406*a* may receive instructions from a master or host logic circuitry to change the initial address to a temporary second address. In some examples, the temporary second address may be an address which is selected by the master or host logic circuitry. This may allow the second logic circuit 406*a* to be provided in one of a plurality of packages 400 on the same I2C bus which, at least initially, share the same initial second address. This shared, default, address may later be set to a specific temporary address by the print apparatus logic circuit, thereby allowing the plurality of packages to have different second addresses during their temporary use, facilitating communications to each individual package. At the same time, providing the same initial second address may have manufacturing or testing advantages. In this disclosure, the temporary second address is also referred to as third address, temporary address, or reconfigured address.

In some examples, the second logic circuit 406*a* may include a memory. The memory may include a programmable address register to store the initial and/or temporary second address (in some examples in a volatile manner). In some examples, the second address may be set following, and/or by executing, an I2C write command. In some examples, the second address may be settable when the enablement signal is present or high, but not when it is absent or low. The second address may be set to a default address when an enablement signal is removed and/or on restoration of enablement of the second logic circuit 406*a*. For example, each time the enable signal over the signal path 408 is low, the second logic circuit 406*a*, or the relevant part(s) thereof, may be reset. The default address may be set when the second logic circuit 406*a*, or the relevant part(s) thereof, is switched out-of-reset. In some examples, the default address is a 7-bit or 10-bit identification value. In some examples, the default address and the temporary second address may be written in turn to a single, common, address register.

In the example illustrated in FIG. 4B, the second logic circuit 406*a* includes a first array 410 of cells and at least one second cell 412 or second array of second cells of a different type than the cells of the first array 410. In some examples, the second logic circuit 406*a* may include additional sensor cells of a different type than the cells of the first array 410 and the at least one second cell 412. Each of the plurality of sensor types may be identifiable by a different sensor ID, while each cell in a cell array of the same type may be identifiable by sub-IDs. The sensor IDs and sub-IDs may include a combination of addresses and values, for example register addresses and values. The addresses of the sensor ID and sub-ID are different. For example, an address selects a register that has a function to select a particular sensor or cell, and in the same transaction, the value selects the sensor or cell, respectively. Hence, the second logic circuit may include registers and multiplex circuitry to select sensor cells in response to sensor IDs and sub-IDs.

The first cells 416*a*-416*f*, 414*a*-414*f* and the at least one second cell 412 can include resistors. The first cells 416*a*-416*f*, 414*a*-414*f* and the at least one second cell 412 can include sensors. In one example, the first cell array 410 includes a print material level sensor and the at least one second cell 412 includes another sensor and/or another sensor array, such as an array of strain sensing cells. Further sensor types may include temperature sensors, resistors, diodes, crack sensors, etc.

In this example, the first cell array 410 includes a sensor configured to detect a print material level of a print supply, which may in some examples be a solid but in examples described herein is a liquid, for example, an ink or other liquid print agent. The first cell array 410 may include a series of temperature sensors (e.g., cells 414*a*-414*f*) and a series of heating elements (e.g., cells 416*a*-416*f*), for example similar in structure and function as compared to the level sensor arrays described in WO2017/074342, WO2017/184147, and WO2018/022038. In this example, the resistance of a resistor cell 414 is linked to its temperature. The heater cells 416 may be used to heat the sensor cells 414 directly or indirectly using a medium. The subsequent behavior of the sensor cells 414 depends on the medium in which they are submerged, for example whether they are in liquid (or in some examples, encased in a solid medium) or in air. Those which are submerged in liquid/encased may generally lose heat quicker than those which are in air because the liquid or solid may conduct heat away from the resistor cells 414 better than air. Therefore, a liquid level may be determined based on which of the resistor cells 414 are exposed to the air, and this may be determined based on a reading of their resistance following (at least the start of) a heat pulse provided by the associated heater cell 416.

In some examples, each sensor cell 414 and heater cell 416 are stacked with one being directly on top of the other. The heat generated by each heater cell 416 may be substantially spatially contained within the heater element layout perimeter, so that heat delivery is substantially confined to the sensor cell 414 stacked directly above the heater cell 416. In some examples, each sensor cell 414 may be arranged between an associated heater cell 416 and the fluid/air interface.

In this example, the second cell array 412 includes a plurality of different cells that may have a different function such as different sensing function(s). For example, the first and second cell array 410, 412 may include different resistor types. Different cells arrays 410, 412 for different functions may be provided in the second logic circuit 406*a*.

Figure 4C:
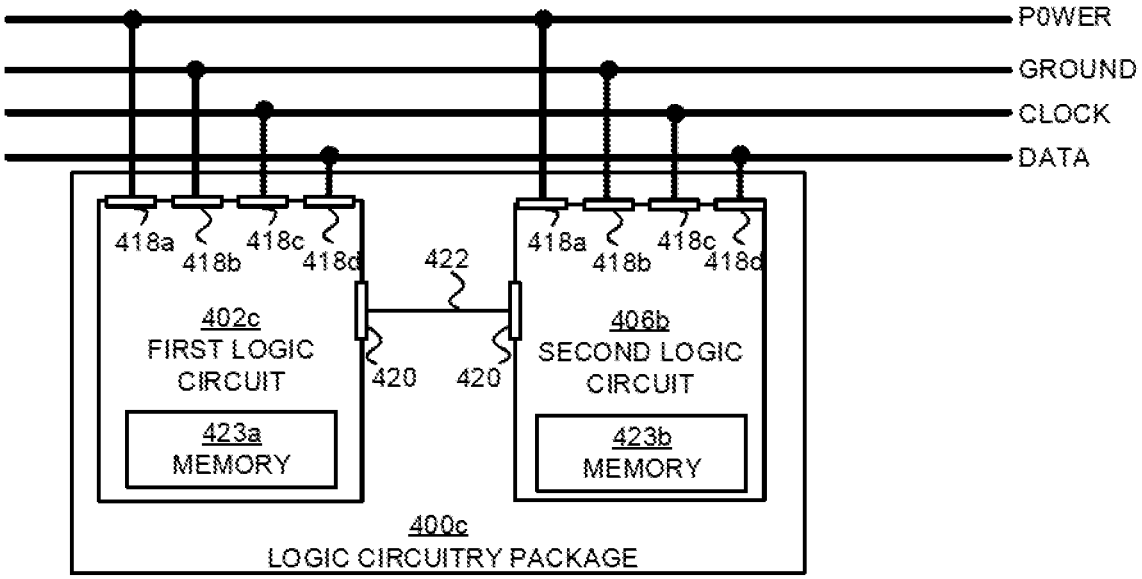

FIG. 4C illustrates an example of how a first logic circuit 402*c* and a second logic circuit 406*b* of a logic circuitry package 400*c*, which may have any of the attributes of the circuits/packages described above, may connect to an I2C bus and to each other. As is shown in the Figure, each of the circuits 402*c*, 406*b* has four pads (or pins) 418*a*-418*d* connecting to the Power, Ground, Clock, and Data lines of an I2C bus. In another example, four common connection pads are used to connect both logic circuits 402*c*, 406*b* to four corresponding connection pads of the print apparatus controller interface. It is noted that in some examples, instead of four connection pads, there may be less connection pads. For example, power may be harvested from the clock pad; an internal clock may be provided; or the package could be grounded through another ground circuit; so that, one or more of the pads may be omitted or made redundant. Hence, in different examples, the package could use only two or three interface pads and/or could include "dummy" pads.

Each of the circuits 402*c*, 406*b* has a contact pin 420, which are connected by a common signal line 422. The contact pin 420 of the second circuit serves as an enablement contact thereof.

In this example, each of the first logic circuit 402*c* and the second logic circuit 406*b* include a memory 423*a*, 423*b*. The memory 423*a* of the first logic circuit 402*c* stores information including cryptographic values (for example, a cryptographic key and/or a seed value from which a key may be derived) and identification data and/or status data of the associated replaceable print apparatus component. In some examples, the memory 423*a* may store data representing characteristics of the print material, for example, any part, or any combination of its type, color, color map, recipe, batch number, age, etc.

The memory 423*b* of the second logic circuit 406*b* includes a programmable address register to contain an initial address of the second logic circuit 406*b* when the second logic circuit 406*b* is first enabled and to subsequently contain a further (temporary) second address (in some examples in a volatile manner). The further, e.g., temporary, second address may be programmed into the second address register after the second logic circuit 406*b* is enabled, and may be effectively erased or replaced at the end of an enablement period. In some examples, the memory 423*b* may further include programmable registers to store any, or any combination of a read/write history data, cell (e.g., resistor or sensor) count data, Analog to Digital converter data (ADC and/or DAC), and a clock count, in a volatile or non-volatile manner. The memory 423*b* may also receive and/or store calibration parameters, such as offset and gain parameters. Use of such data is described in greater detail below. Certain characteristics, such as cell count or ADC or DAC characteristics, could be derivable from the second logic circuit instead of being stored as separate data in the memory.

In one example, the memory 423*b* of the second logic circuit 406*b* stores any or any combination of an address, for example the second I2C address; an identification in the form of a revision ID; and the index number of the last cell (which may be the number of cells less one, as indices may start from 0), for example for each of different cell arrays or for multiple different cell arrays if they have the same number of cells.

In use of the second logic circuit 406*b*, in some operational states, the memory 423*b* of the second logic circuit 406 may store any or any combination of timer control data, which may enable a timer of the second circuit, and/or enable frequency dithering therein in the case of some timers such as ring oscillators; a dither control data value (to indicate a dither direction and/or value); and a timer sample test trigger value (to trigger a test of the timer by sampling the timer relative to clock cycles measureable by the second logic circuit 406*b*).

While the memories 423*a*, 423*b* are shown as separate memories here, they could be combined as a shared memory resource, or divided in some other way. The memories 423*a*, 423*b* may include a single or multiple memory devices, and may include any or any combination of volatile memory (e.g., DRAM, SRAM, registers, etc.) and non-volatile memory (e.g., ROM, EEPROM, Flash, EPROM, memristor, etc.).

While one package 400*c* is shown in FIG. 4C, there may be a plurality of packages with a similar or a different configuration attached to the bus.

Figure 4D:
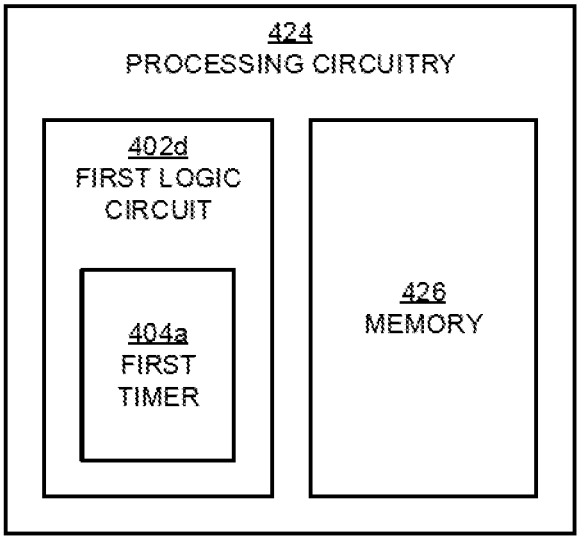

FIG. 4D illustrates an example of processing circuitry 424 which is for use with a print material container. For example, the processing circuitry 424 may be affixed or integral thereto. As already mentioned, the processing circuitry 424 may include any of the features of, or be the same as, any other logic circuitry package of this disclosure.

In this example, the processing circuitry 424 includes a memory 426 and a first logic circuit 402*d* which enables a read operation from memory 426. The processing circuitry 424 is accessible via an interface bus of a print apparatus in which the print material container is installed and is associated with a first address and at least one second address. The bus may be an I2C bus. The first address may be an I2C address of the first logic circuit 402*d*. The first logic circuit 402*d* may have any of the attributes of the other examples circuits/packages described in this disclosure.

The first logic circuit 402*d* is adapted to participate in authentication of the print materials container by a print apparatus in which the container is installed. For example, this may include a cryptographic process such as any kind of cryptographically authenticated communication or message exchange, for example based on a cryptographic key stored in the memory 426, and which can be used in conjunction with information stored in the printer. In some examples, a printer may store a version of a key which is compatible with a number of different print material containers to provide the basis of a 'shared secret'. In some examples, authentication of a print material container may be carried out based on such a shared secret. In some examples, the first logic circuit 402*d* may participate in a message to derive a session key with the print apparatus and messages may be signed using a message authentication code based on such a session key. Examples of logic circuits configured to cryptographically authenticate messages in accordance with this paragraph are described in US patent publication No. 9619663.

In some examples, the memory 426 may store data including: identification data and read/write history data. In some examples, the memory 426 further includes cell count data (e.g., sensor count data) and clock count data. Clock count data may indicate a clock speed of a first and/or second timer 404*a*, 404*b* (i.e., a timer associated with the first logic circuit or the second logic circuit). In some examples, at least a portion of the memory 426 is associated with functions of a second logic circuit, such as a second logic circuit 406*a* as described in relation to FIG. 4B above. In some examples, at least a portion of the data stored in the memory 426 is to be communicated in response to commands received via the second address. In some examples, the memory 426 includes a programmable address register or memory field to store a second address of the processing circuitry (in some examples in a volatile manner). The first logic circuit 402*d* may enable read operation from the memory 426 and/or may perform processing tasks.

The memory 426 may, for example, include data representing characteristics of the print material, for example any or any combination of its type, color, batch number, age, etc. The memory 426 may, for example, include data to be communicated in response to commands received via the first address. The processing circuitry may include a first logic circuit to enable read operations from the memory and perform processing tasks.

In some examples, the processing circuitry 424 is configured such that, following receipt of the first command indicative of a task and a first time period sent to the first logic circuit 402*d* via the first address, the processing circuitry 424 is accessible by at least one second address for a duration of the first time period. Alternatively or additionally, the processing circuitry 424 may be configured such that in response to a first command indicative of a task and a first time period sent to the first logic circuit 402*d* addressed using the first address, the processing circuitry 424 is to disregard (e.g., 'ignore' or 'not respond to') I2C traffic sent to the first address for substantially the duration of the time period as measured by a timer of the processing circuitry 424 (for example a timer 404*a*, 404*b* as described above). In some examples, the processing circuitry may additionally perform a task, which may be the task specified in the first command. The term 'disregard' or 'ignore' as used herein with respect to data sent on the bus may include any or any combination of not receiving (in some examples, not reading the data into a memory), not acting upon (for example, not following a command or instruction) and/or not responding (i.e., not providing an acknowledgement, and/or not responding with requested data).

The processing circuitry 424 may have any of the attributes of the logic circuitry packages 400 described herein. In particular, the processing circuitry 424 may further include a second logic circuit wherein the second logic circuit is accessible via the second address. In some examples, the second logic circuit may include at least one sensor which is readable by a print apparatus in which the print material container is installed via the second address. In some examples, such a sensor may include a print materials level sensor.

Figure 4E:
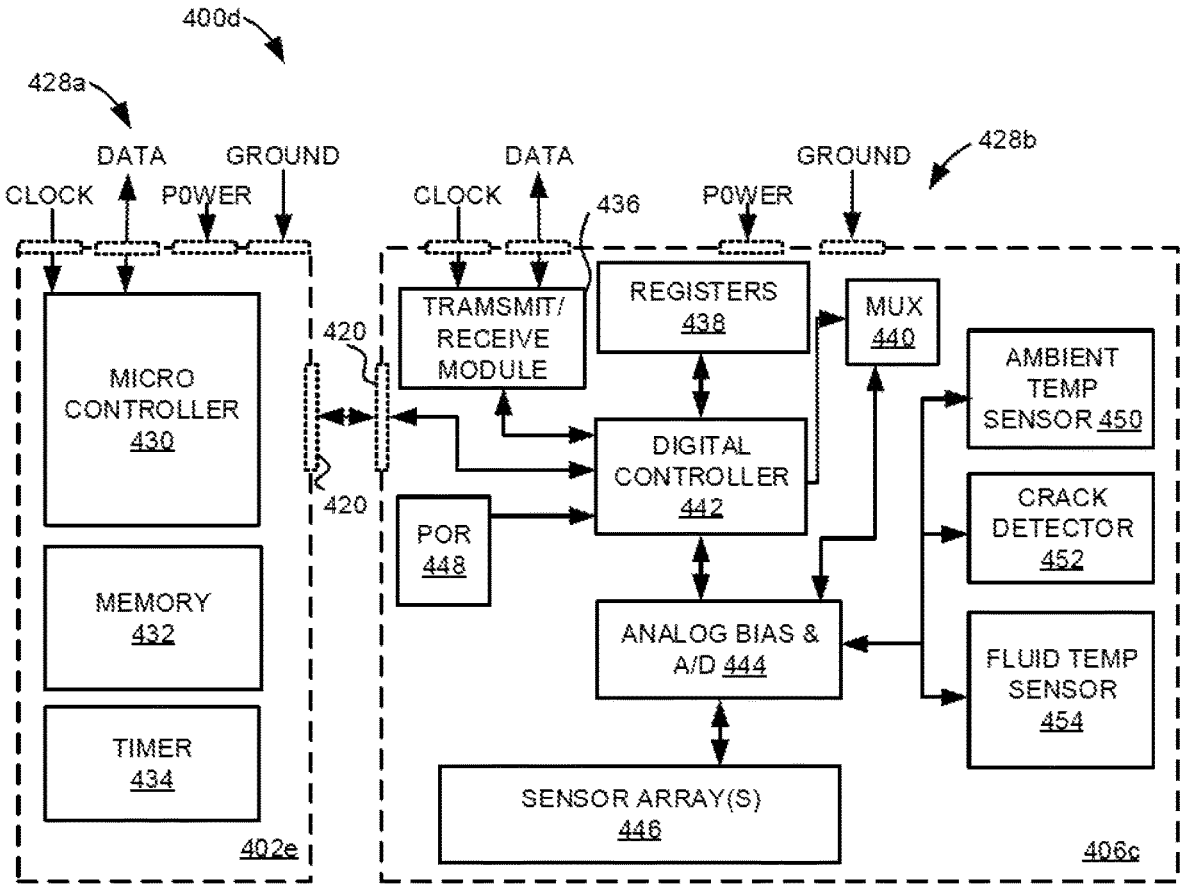

FIG. 4E illustrates another example of a first logic circuit 402*e* and second logic circuit 406*c* of a logic circuitry package 400*d*, which may have any of the attributes of the circuits/packages of the same names described herein, which may connect to an I2C bus via respective interfaces 428*a*, 428*b* and to each other. In one example the respective interfaces 428*a*, 428*b* are connected to the same contact pad array, with only one data pad for both logic circuits 402*e*, 406*c*, connected to the same serial I2C bus. In other words, in some examples, communications addressed to the first and the second address are received via the same data pad.

In this example, the first logic circuit 402*e* includes a microcontroller 430, a memory 432, and a timer 434. The microcontroller 430 may be a secure microcontroller or customized integrated circuitry adapted to function as a microcontroller, secure or non-secure.

In this example, the second logic circuit 406*c* includes a transmit/receive module 436, which receives a clock signal and a data signal from a bus to which the package 400*d* is connected, data registers 438, a multiplexer 440, a digital controller 442, an analog bias and analog to digital converter 444, at least one sensor or cell array 446 (which may in some examples include a level sensor with one or multiple arrays of resistor elements), and a power-on reset (POR) device 448. The POR device 448 may be used to allow operation of the second logic circuit 406*c* without use of a contact pin 420.

The analog bias and analog to digital converter 444 receives readings from the sensor array(s) 446 and from additional sensors. For example, a current may be provided to a sensing resistor and the resultant voltage may be converted to a digital value. That digital value may be stored in a register and read out (i.e., transmitted as serial data bits, or as a 'bitstream') over the I2C bus. The analog to digital converter 444 may utilize parameters, for example, gain and/or offset parameters, which may be stored in registers.

In this example, there are different additional single sensors, including for example at least one of an ambient temperature sensor 450, a crack detector 452, and/or a fluid temperature sensor 454. These may sense, respectively, an ambient temperature, a structural integrity of a die on which the logic circuitry is provided, and a fluid temperature.

Figure 5A:
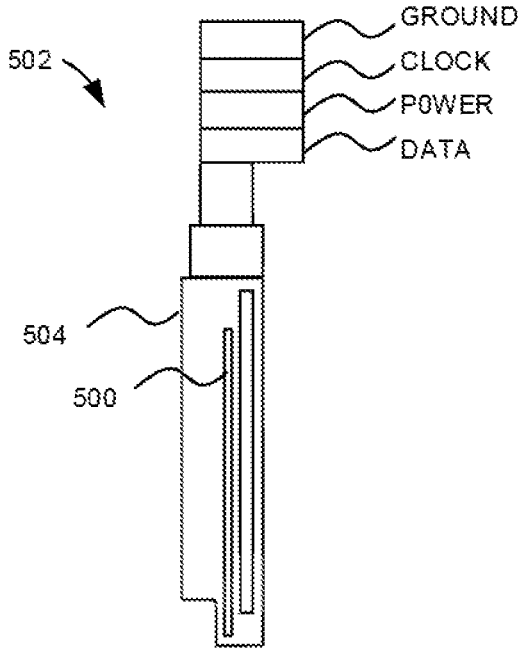
FIG. 5A illustrates one example arrangement of a fluid level sensor.

FIG. 5A illustrates an example of a possible practical arrangement of a second logic circuit embodied by a sensor assembly 500 in association with a circuitry package 502. The sensor assembly 500 may include a thin film stack and include at least one sensor array such as a fluid level sensor array. The arrangement has a high length to width aspect ratio (e.g., as measured along a substrate surface), for example being around 0.2 mm in width, for example less than 1 mm, 0.5 mm, or 0.3 mm, and around 20 mm in length, for example more than 10 mm, leading to length to width aspect ratios equal to or above approximately 20:1, 40:1, 60:1, 80:1, or 100:1. In an installed condition the length may be measured along the height. The logic circuit in this example may have a thickness of less than 1 mm, less than 0.5 mm, or less than 0.3 mm, as measured between the bottom of the (e.g., silicon) substrate and the opposite outer surface. These dimensions mean that the individual cells or sensors are small. The sensor assembly 500 may be provided on a relatively rigid carrier 504, which in this example also carries Ground, Clock, Power and Data I2C bus contacts.

Figure 5B:
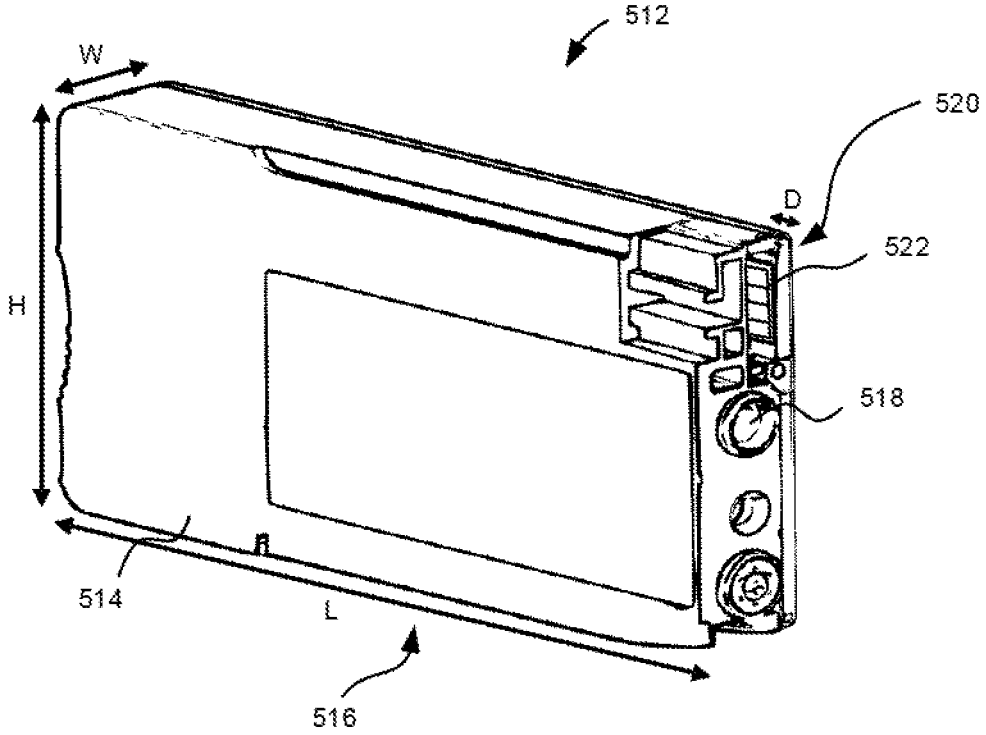
FIG. 5B illustrates a perspective view of one example of a print cartridge.

FIG. 5B illustrates a perspective view of a print cartridge 512 including a logic circuitry package of any of the examples of this disclosure. The print cartridge 512 has a housing 514 that has a width W less than its height H and that has a length L or depth that is greater than the height H. A print liquid output 516 (in this example, a print agent outlet provided on the underside of the cartridge 512), an air input 518 and a recess 520 are provided in a front face of the cartridge 512. The recess 520 extends across the top of the cartridge 512 and I2C bus contacts (i.e., pads) 522 of a logic circuitry package 502 (for example, a logic circuitry package 400*a*-400*d* as described above) are provided at a side of the recess 520 against the inner wall of the side wall of the housing 514 adjacent the top and front of the housing 514. In this example, the data contact is the lowest of the contacts 522. In this example, the logic circuitry package 502 is provided against the inner side of the side wall. In some examples, the logic circuitry package 502 includes a sensor assembly as shown in FIG. 5A.

Placing logic circuitry within a print material cartridge may create challenges for the reliability of the cartridge due to the risks that electrical shorts or damage can occur to the logic circuitry during shipping and user handling, or over the life of the product.

A damaged sensor may provide inaccurate measurements, and result in inappropriate decisions by a print apparatus when evaluating the measurements. Therefore, a method may be used to verify that communications with the logic circuitry based on a specific communication sequence provide expected results. This may validate the operational health of the logic circuitry.

In other examples, a replaceable print apparatus component includes a logic circuitry package of any of the examples described herein, wherein the component further includes a volume of liquid. The component may have a height H that is greater than a width W and a length L that is greater than the height, the width extending between two sides. Interface pads of the package may be provided at the inner side of one of the sides facing a cut-out for a data interconnect to be inserted, the interface pads extending along a height direction near the top and front of the component, and the data pad being the bottom-most of the interface pads, the liquid and air interface of the component being provided at the front on the same vertical reference axis parallel to the height H direction wherein the vertical axis is parallel to and distanced from the axis that intersects the interface pads (i.e., the pads are partially inset from the edge by a distance D). The rest of the logic circuitry package may also be provided against the inner side.

Figure 6A:
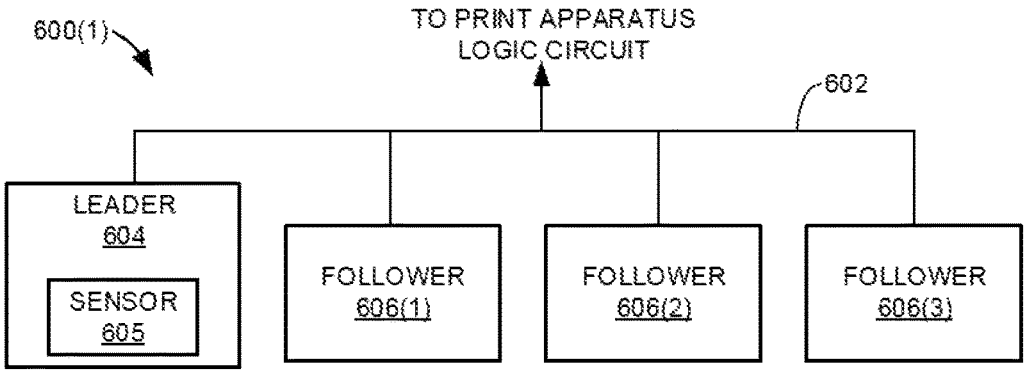
FIGS. 6A-6C illustrate example configurations of replaceable print apparatus components including leader and follower components.
Figure 6B:
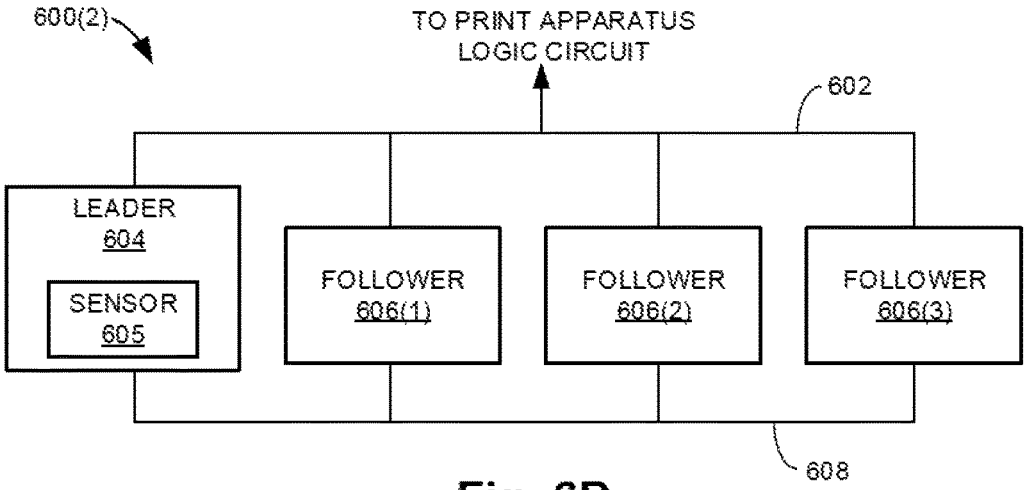
Figure 6C:
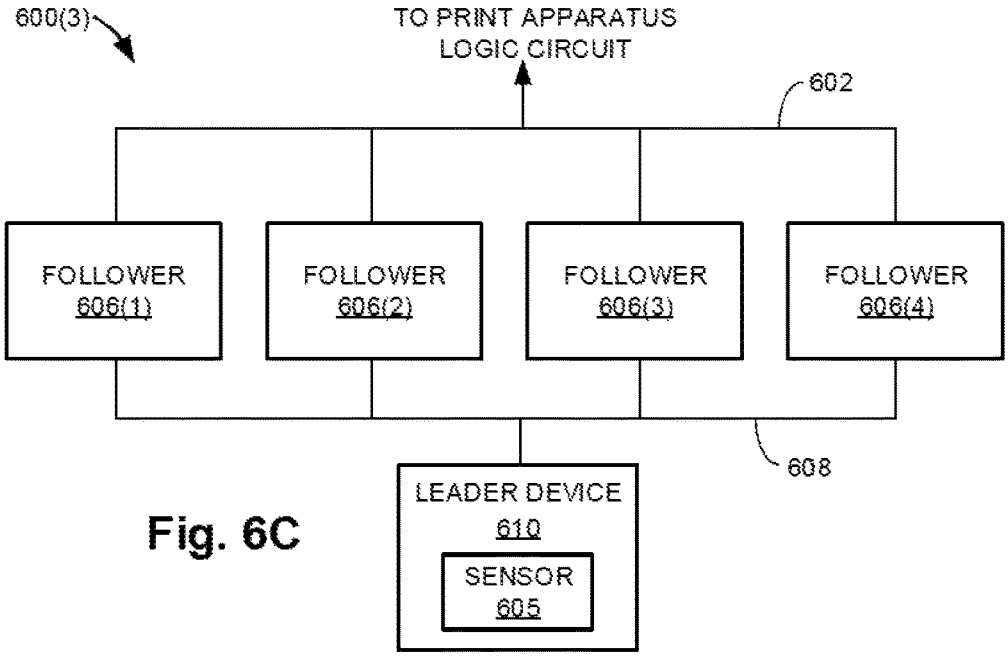

FIGS. 6A-6C illustrate example configurations of replaceable print apparatus components including leader and follower components. In one example, the leader and follower components are print supply components. As shown in FIG. 6A, configuration 600(1) includes leader component 604 and follower components 606(1)-606(3), which are communicatively coupled to each other and to a print apparatus logic circuit (not shown) via communication bus 602. In one example, communication bus 602 is an I2C bus. Leader component 604 may include any of the logic circuitry described herein, and includes at least one analog sensor 605. Sensor 605 may include a plurality of different types of sensors (e.g., a sensor array of ink level sensor cells, a sensor array of strain gauge sensor cells, as well as individual sensors, such as a global thermal sensor, thermal diode, a crack detect sensor, or any other type of sensor). In one example, follower components 606(1)-606(3) do not include a sensor 605, and are digital-only devices.

In operation according to one example, the leader component 604 receives, via the communication bus 602, a request from the print apparatus logic circuit to provide sensor information from the sensor 605. In response to the request, the leader component 604 causes the sensor 605 to generate sensor information, and provides a response to the request including the sensor information, via the communication bus 602, to the print apparatus logic circuit. Each of the follower components 606(1)-606(3) monitors the request sent to the leader component 604, and the response from the leader component 604, via the communication bus 602. When any of the follower components 606(1)-606(3) receives, via the communication bus 602, the same type of request that was previously sent to the leader component 604, that follower component responds, via the communication bus 602, with the same response that the leader component 604 previously sent. In this manner, for requests related to sensor information, the follower components 606(1)-606(3) mime the responses of the leader component 604. This allows the print apparatus logic circuit to treat all of the components the same regardless of whether they include a sensor 605, and enables any combination of leader/follower components to complete a full set in a print apparatus.

As shown in FIG. 6B, configuration 600(2) is the same as configuration 600(1) (FIG. 6A), with the exception that a communication link 608 is added that communicatively couples together the leader component 604 and the follower components 606(1)-606(3). In one example, the print apparatus logic circuit is not coupled to the communication link 608. In one example, communication link 608 is an I2C bus, a wireless communication link (e.g., Bluetooth), or another type of communication link. Communication link 608 allows the leader component 604 and the follower components 606(1)-606(3) to directly communicate with each other, including providing sensor information from the leader component 604 to the follower components 606(1)-606(3). The follower components 606(1)-606(3) can then provide this sensor information to the print apparatus logic circuit via communication link 602 when requested by the print apparatus logic circuit. Communication link 608 allows the leader component 604 to transmit and receive directly with the follower components 606(1)-606(3) to exchange whatever information is requested, without having to rely on the print apparatus logic circuit to drive I2C communications. Communication link 608 also helps reduce the risk of interfering with printer communications.

As shown in FIG. 6C, configuration 600(3) includes leader device 610 with sensor 605, and follower components 606(1)-606(4). In one example, leader device 610 is not a print supply component, but rather is a permanent or semi-permanent device that is installed in a print apparatus and is capable of sensing functionality (e.g., via sensor 605). Follower components 606(1)-606(4) are communicatively coupled to each other and to a print apparatus logic circuit (not shown) via communication bus 602. Follower components 606(1)-606(4) are communicatively coupled to each other and to leader device 610 via communication link 608. Communication link 608 allows the leader device 610 and the follower components 606(1)-606(4) to directly communicate with each other, including providing sensor information from the leader device 610 to the follower components 606(1)-606(4). The follower components 606(1)-606(4) can then provide this sensor information to the print apparatus logic circuit via communication link 602 when requested by the print apparatus logic circuit. Communication link 608 allows the leader device 610 to transmit and receive directly with the follower components 606(1)-606(4) to exchange whatever information is requested, without having to rely on the print apparatus logic circuit to drive I2C communications.

Figure 7A:
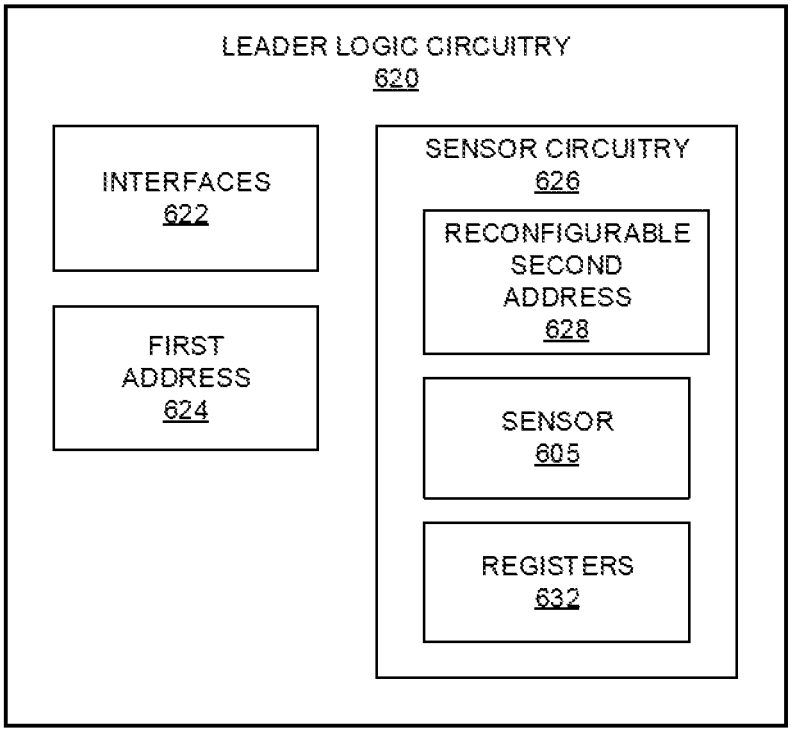
FIG. 7A illustrates one example of leader logic circuitry.

FIG. 7A illustrates one example of leader logic circuitry 620. In one example, leader component 604 (FIGS. 6A-6B) and leader device 610 (FIG. 6C) include leader logic circuitry 620. Leader logic circuitry 620 includes interfaces 622, first address 624, and sensor circuitry 626. In one example, interfaces 622 include an I2C interface for communicating via communication bus 602 (FIGS. 6A-6C), and may include an additional interface for communicating via communication link 608 (FIGS. 6B and 6C). One or more of the interfaces 622 may be incorporated into the sensor circuitry 626. In one example, the sensor circuitry 626 includes reconfigurable second address 628, sensor 605, and registers 632. In one example, registers 632 include registers for enabling and configuring sensor 605, and storing sensor information generated by sensor 605.

In one example, first address 624 and reconfigurable second address 628 are I2C communication addresses. In other examples, first address 624 and reconfigurable second address 628 may be another type of communication address. The leader logic circuitry 620 is addressable via the first address 624. In one example, the first address 624 is a fixed default address value (e.g., "hard-wired") that is intended to remain the same address during the lifetime of the leader logic circuitry 620. In example systems where a plurality of leader logic circuits 620 are to be connected to a single print apparatus, there may be a corresponding plurality of different first addresses.

The leader logic circuitry 620 is also addressable via the reconfigurable second address 628. In the illustrated example, the reconfigurable second address 628 is associated with the sensor circuitry 626. In one example, the reconfigurable second address 628 has a default second address value, while the reconfigurable second address 628 may be reconfigurable to a temporary (e.g., third) address value. In this example, the sensor circuitry 626 is addressable via the reconfigurable second address 628. In some examples, when the sensor circuitry 626 is activated or enabled, it may have the default second address value. The sensor circuitry 626 may receive instructions from a master or host logic circuitry (e.g., a print apparatus logic circuit) to change the default second address value to a temporary address value. In some examples, the temporary address value may be an address that is selected by the print apparatus logic circuit. In example systems where a plurality of leader logic circuits 620 are to be connected to a single print apparatus, the leader logic circuits 620 may all have the same default second address value, and may all have a different temporary address value.

In operation according to one example, a print apparatus circuit sends requests to leader logic circuitry 620 to change the reconfigurable second address 628 from the default second address value to a temporary address value, and to write to registers 632 to enable and configure the sensor 605 to generate sensor information. The print apparatus circuit may then send a request for sensor information using the temporary address value to direct the request to the sensor circuitry 626. The sensor circuitry 626 will receive the request, and in response, cause the sensor 605 to generate sensor information. In one example, the sensor circuitry 626 may store sensor measurement information in registers 632, and send the sensor measurement information from the registers 632 to the print apparatus circuit (e.g., via communication bus 602).

In one example, sensor 605 may be a sensor to detect a prime event (e.g., strain gauge sensor), and the sensor circuitry 626 may receive a plurality of commands to capture and return pressure sensor values that are conditioned by a series of pressurizations. In another example, sensor 605 may be an ink level sensor, and the sensor circuitry 626 may receive a plurality of commands to capture and return ink level values. In another example, the sensor 605 may be a temperature sensor. In again other examples, the sensor 605 may include a plurality of different sensor types including these sensor types whereby each sensor type may comprise one or more sensor cells.

Figure 7B:
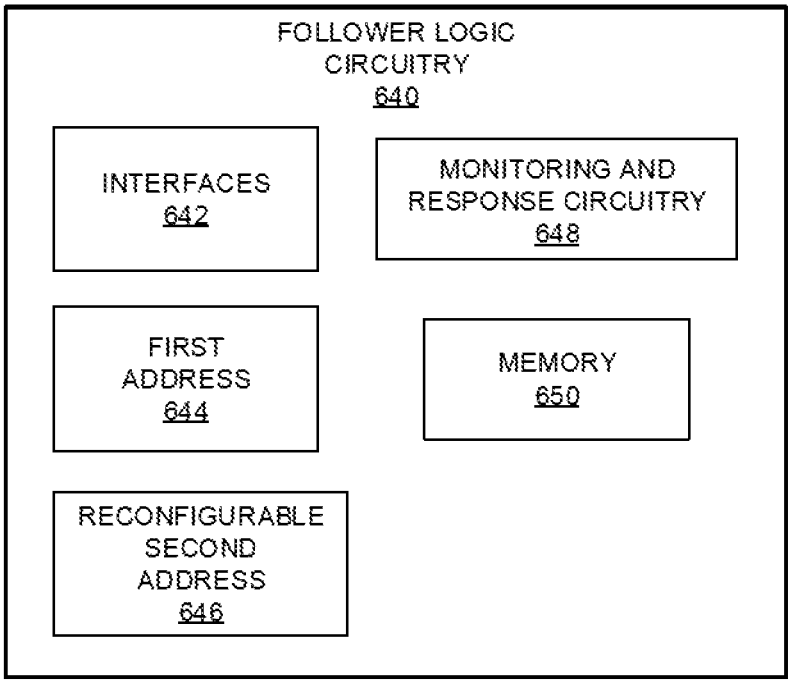
FIG. 7B illustrates one example of follower logic circuitry.

FIG. 7B illustrates one example of follower logic circuitry 640. In one example, each of the follower components 606(1)-606(4) (FIGS. 6A-6C) include follower logic circuitry 640. Follower logic circuitry 640 includes interfaces 642, first address 644, reconfigurable second address 646, monitoring and response circuitry 648, and memory 650. In one example, interfaces 642 include an I2C interface for communicating via communication bus 602 (FIGS. 6A-6C), and may include an additional interface for communicating via communication link 608 (FIGS. 6B and 6C). In one example, follower logic circuitry 640 is digital-only, and does not include an analog sensor.

In one example, first address 644 and reconfigurable second address 646 are I2C communication addresses. In other examples, first address 644 and reconfigurable second address 646 may be another type of communication address. The follower logic circuitry 640 is addressable via the first address 644. In one example, the first address 644 is a fixed default address value (e.g., "hard-wired") that is intended to remain the same address during the lifetime of the follower logic circuitry 640. In example systems where a plurality of follower logic circuits 640 are to be connected to a single print apparatus, there may be a corresponding plurality of different first addresses. In certain examples of this disclosure, logic circuitry of the leader and/or follower component may store instructions (in a memory) to instruct a processor to respond to commands to a default first address, a default second address, and to a third address (i.e., the temporary second address) after reconfiguration by a command to the default second address, without necessarily having a hard-wired or reconfigurable address field, but rather, by monitoring the addresses and responding based on these instructions.

The follower logic circuitry 640 is also addressable via the reconfigurable second address 644, which may be reconfigured to a temporary address (e.g., third address). In one example, the second address 644 has a default address value out-of-reset, while the second address 644 may be reconfigurable to a temporary address value. The follower logic circuitry 640 may receive instructions from a master or host logic circuitry (e.g., a print apparatus logic circuit) to change the default second address value to a temporary address value. In some examples, the temporary address value may be an address that is selected by the print apparatus logic circuit. In example systems where a plurality of follower logic circuits 640 are to be connected to a single print apparatus, the follower logic circuits 640 may all have the same default second address value, and may all be reconfigured by the print apparatus logic circuit to a different temporary address value.

FIG. 8 illustrates a table with example address names for multiple replaceable print apparatus components. Multiple replaceable print apparatus components may be incorporated into a single print apparatus, and such components may all include a first default address (e.g., first address 624 or 644) that may have a preconfigured, default first address value, and a reconfigurable second address (e.g., second address 628 or 646) that may have either a default second address value or a temporary address value after reconfiguration by the print apparatus logic circuit. In the illustrated example, the components include first replaceable print apparatus component 902(1), other replaceable print apparatus component 902(2), and further replaceable print apparatus component 902(3). The first replaceable print apparatus component 902(1) includes first default address 904(1), second default address 906(1), and third/reconfigured/temporary address 908(1). The other replaceable print apparatus component 902(2) includes other first default address 904 (2), second default address 906(2), and third/reconfigured/temporary address 908(2). The further replaceable print apparatus component 902(3) includes further first default address 904(3), second default address 906(3), and further third/reconfigured/temporary address 908(3).

In one example, the first default addresses 904(1)-904(3) are pre-configured or fixed addresses that are different for each of the components 902(1)-902(3). In one example, the second default addresses 906(1)-906(3) are pre-configured or fixed addresses that are the same for each of the components 902(1)-902(3). In one example, the addresses 908(1)-908(3) are reconfigurable temporary addresses that are configured by the print apparatus logic circuit, and in an example of this disclosure chosen to be different for each of the components 902(1)-902(3).

In operation according to one example, monitoring and response circuitry 648 monitors the communication bus 602 via one of the interfaces 642 for commands directed to addresses (e.g., first address 624 and reconfigurable second address 628 of leader logic circuitry 620) other than its own addresses (e.g., first address 644 and/or reconfigurable second address 646), and also monitors corresponding responses to those commands. The monitored communications may include commands and responses related to enabling and configuring sensor 605, as well as commands and responses related to causing sensor 605 to generate sensor information. Monitoring and response circuitry 648 may store the monitored commands and/or corresponding responses in memory 650, and/or may store timing information for the commands and responses in memory 650. In some examples, monitoring and response circuitry 648 may store an approximation or condensed summary of the commands and/or responses in memory 650.

In response to commands directed to the address 644 or 646 of the follower logic circuitry 640, the monitoring and response circuitry 648 may access memory 650 and mimic previously monitored responses corresponding to such commands, or may output a pre-stored response sequence upon detecting a specific type of command (e.g., a prime command). The monitoring and response circuitry 648 may also access the timing information stored in memory 650, and mimic the timing of previously monitored communications. The stored timing information may be used for timing/triggers of pre-stored responses. The monitoring and response circuitry 648 may also make modifications to monitored responses to produce its own responses (e.g., adding some noise to response values, choosing modified baseline values, or making other modifications to response values).

By monitoring and mimicking responses of the leader logic circuitry 620, the follower logic circuitry 640 may provide valid sensor values without the expense of including an analog sensor to generate those values. For example, when requested to return a series of strain gauge sensor values, a response may include a number of "baseline" readings (i.e., in a resting state, before the pressurization has actually occurred), followed by a series of readings that match the pressurization spikes. The monitoring and response circuitry 648 can monitor the responses of other components that include leader logic circuitry 620, and when the circuitry 648 sees a component that has begun to deviate from its baseline readings, the circuitry 648 can copy those responses, or use them as a trigger for its own pre-stored responses.

In one example, a command, such as a write command, sent from a print apparatus logic circuit to leader logic circuitry 620 or follower logic circuitry 640, may include an address frame that identifies a communication address of the intended destination of the command (e.g., a first address 624 or 644, or a reconfigurable second address 628 or 646), a sub-address frame that identifies a memory or register address (e.g., an address of one of the registers 632) at the intended destination, and a value frame that identifies a value to write to the register identified by the sub-address frame. Acknowledge bits may be provided between frames, and certain other bits may be included in the command, such as start bits, stop bits, and/or other bits. The command structure may follow an I2C communication protocol.

By looking at the address frame of all commands sent from the print apparatus logic circuit, the monitoring and response circuitry 648 can see which one of the components is being addressed. The monitoring and response circuitry 648 can also determine the function/meaning of the various registers 632 by looking at the sub-address and value frames of commands and the corresponding responses to the commands. This information helps the monitoring and response circuitry 648 to monitor what is occurring between the print apparatus logic circuit and the other components in order to provide valid responses.

In one example, communications between the print apparatus logic circuit and the leader logic circuitry 620 involving the first address 624 include a command from the print apparatus logic circuit indicating a time period in which the leader logic circuitry 620 is accessible via the reconfigurable second address 628. In one example, communications between the print apparatus logic circuit and the follower logic circuitry 640 involving the first address 644 include a command from the print apparatus logic circuit indicating a time period in which the follower logic circuitry 640 is accessible via the reconfigurable second address 646.

In one example, communications between the print apparatus logic circuit and the leader logic circuitry 620 involving the first address 624, and communications between the print apparatus logic circuit and the follower logic circuitry 640 involving the first address 644, are cryptographically authenticated communications. In one example, communications between the print apparatus logic circuit and the leader logic circuitry 620 involving the reconfigurable second address 628, and communications between the print apparatus logic circuit and the follower logic circuitry 640 involving the reconfigurable second address 646, are not encrypted and are non-cryptographically authenticated communications.

In one example, monitoring and response circuitry 648 monitors cryptographically authenticated communications from a print apparatus logic circuit to the first address 624 of the leader logic circuitry 620, and monitors cryptographically authenticated responses to these communications provided by the leader logic circuitry 620. These monitored communications may include a command from the print apparatus logic circuit that indicates a time period in which the leader logic circuitry 620 is accessible via the reconfigurable second address 628. Monitoring and response circuitry 648 next monitors non-cryptographically authenticated communications from a print apparatus logic circuit to the reconfigurable second address 628 of the leader logic circuitry 620, and monitors non-cryptographically authenticated responses to these communications provided by the leader logic circuitry 620.

In one example, the monitored non-cryptographically authenticated communications include a command-response sequence to register addresses of registers 632. The monitoring and response circuitry 648 may distinguish the leader logic circuitry 620 from follower components by detecting that the response data in the command-response sequence for the leader logic circuitry 620 will be changing, whereas the response data may not be initially changing for the follower components. The monitoring and response circuitry 648 may store the command-response sequence in memory 650. In some examples, the monitoring and response circuitry 648 may store an approximation or condensed summary of the command-response sequence in memory 650.

After monitoring the communications of the leader logic circuitry 620, the follower logic circuitry 640 may receive cryptographically authenticated communications from the print apparatus logic circuit to the first address 644 of the follower logic circuitry 640, followed by non-cryptographically authenticated communications from the print apparatus logic circuit to the reconfigurable second address 646 of the follower logic circuitry 640, including commands from the print apparatus logic circuit that specify addresses of registers. If the monitoring and response circuitry 648 determines that the specified register addresses match the register addresses in the command-response sequence information stored in memory 650, the monitoring and response circuitry 648 responds to the print apparatus logic circuit with the stored response values, or a modified version of the stored response values, or pre-stored response values. In one example, the monitoring and response circuitry 648 copies only certain response values from leader logic circuitry 620 associated with a predetermined subset of queries, such as sensor communications. Response values for other queries may be pre-stored in memory 650 (e.g., Revision ID, Cell Count, Clock Speed, etc.).

In some examples, monitoring and response circuitry 648 performs the following: (1) monitoring of serial communications including cryptographically authenticated communications to first address 624 of circuitry 620, which may include time/enable commands to first address 624 of circuitry 620; (2) monitoring of serial communications including non-cryptographically authenticated communications, which may include communications regarding reconfigurable second address 628 of circuitry 620, register queries to registers 632 of circuitry 620, and responses from circuitry 620 to the register queries; (3) in response to the queries and responses, storing response values; and (4) in response to the same or similar communications to first address 644 and then to reconfigurable second address 646, outputting the stored response values corresponding to the queries.

Figure 9A:
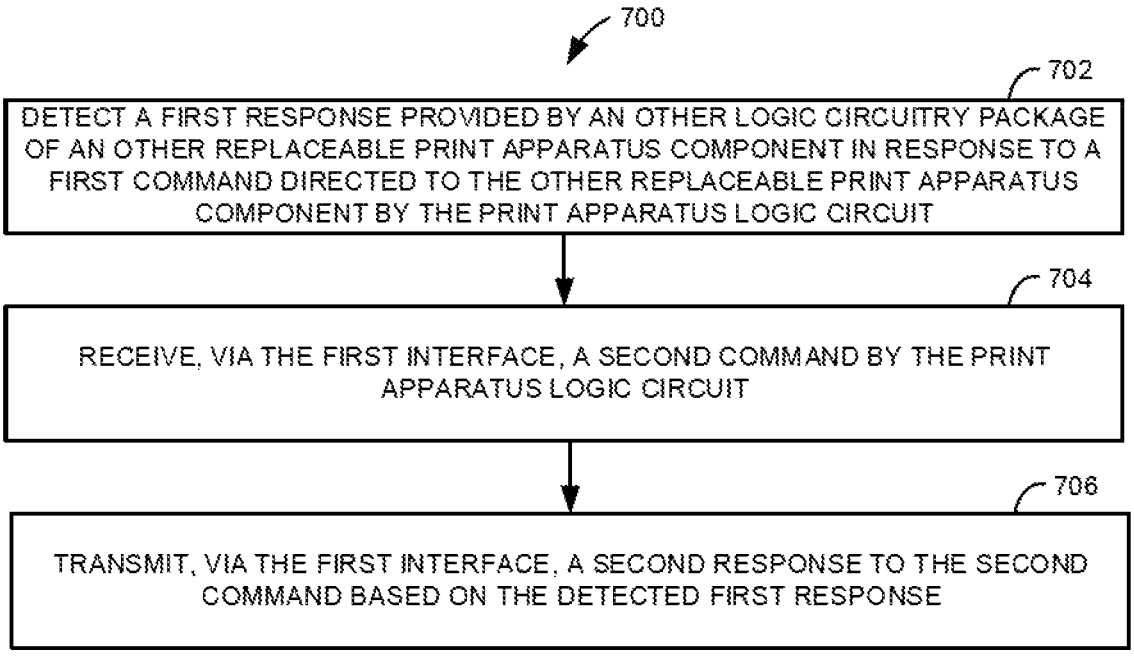
FIGS. 9A-9H are flow diagrams illustrating one example of a method that may be carried out by a logic circuitry package.

FIGS. 9A-9H are flow diagrams illustrating one example of a method 700 that may be carried out by a logic circuitry package, such as logic circuitry package 400*a*-400*d*, or by circuitry 424, 620, or 640. Method 700 may be carried out by a replaceable print apparatus component that includes a logic circuitry package. The logic circuitry package may include a first interface to communicate with a print apparatus logic circuit, and a logic circuit. As illustrated in FIG. 9A at 702, the logic circuit of the logic circuitry package may detect a first response provided by an other logic circuitry package of an other replaceable print apparatus component in response to a first command directed to the other replaceable print apparatus component by the print apparatus logic circuit. At 704, the logic circuit receives, via the first interface, a second command by the print apparatus logic circuit. At 706, the logic circuit transmits, via the first interface, a second response to the second command based on the detected first response.

Figure 9B:
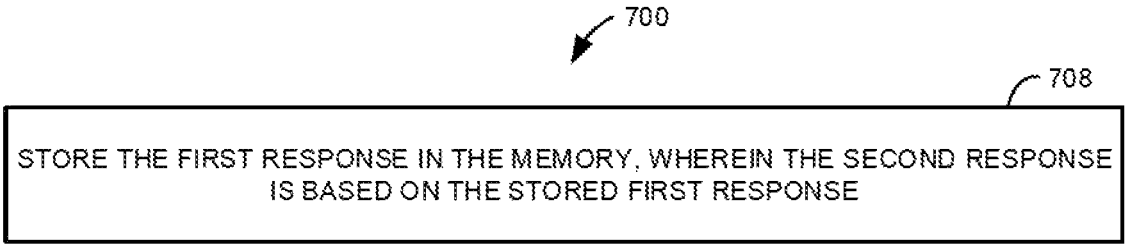

In some examples, the logic circuitry package may include a memory, and, as illustrated in FIG. 9B, at 708, the logic circuit in method 700 may store the first response in the memory, and the second response may be based on the stored first response. In some examples, the logic circuit may store an approximation or condensed summary of the first response in the memory, and the second response may be based on the stored approximation or condensed summary of the first response.

In some examples of method 700, the first command and the second command may each include a series of commands. In some examples, each of the commands may include an I2C address and a register address. In some examples, the first response and the second response may each include a series of responses. In some examples, each of the responses may include a digital count value. The digital count value may represent a natural number of one byte or less.

In some examples of method 700, the first command and the second command may be a same type of command, and the second response may copy information from the first response. In some examples, the first command and the second command may be a same type of command, and the second response may be modified to be similar but not exactly equal to the first response.

Figure 9C:
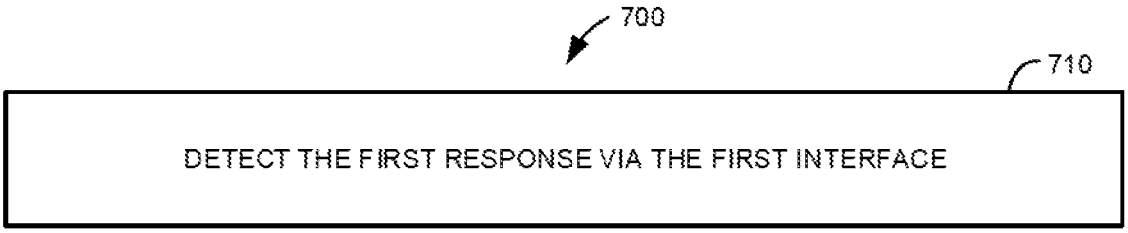

In some examples, as illustrated in FIG. 9C, at 710, the logic circuit may detect the first response via the first interface. In some examples, the first interface may include a power contact and a data contact. In some examples, the first interface may include a ground contact and a clock contact.

Figure 9D:
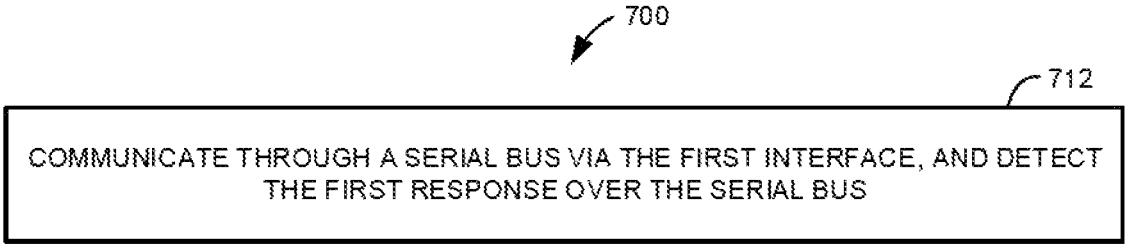

In some examples, as illustrated in FIG. 9D, at 712, the logic circuit may communicate through a serial bus via the first interface, and detect the first response over the serial bus.

Figure 9E:
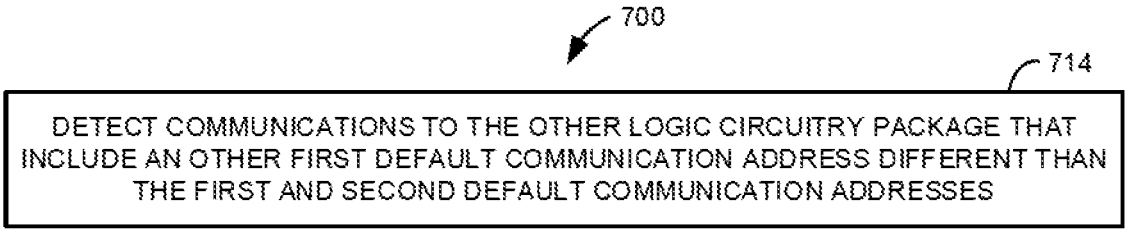

In some examples, the logic circuitry package may include a first default communication address and a second default communication address, and, as illustrated in FIG. 9E, at 714, the logic circuit may detect communications to the other logic circuitry package that include an other first default communication address different than the first and second default communication addresses.

Figure 9F:
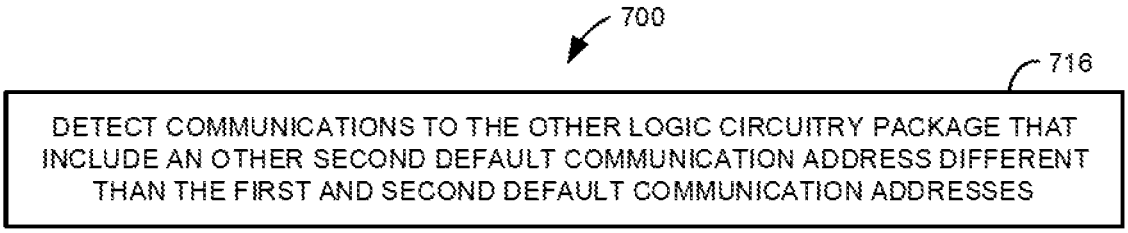

In some examples, as illustrated in FIG. 9F, at 716, the logic circuit may detect communications to the other logic circuitry package that include an other second default communication address different than the first and second default communication addresses.

Figure 9G:
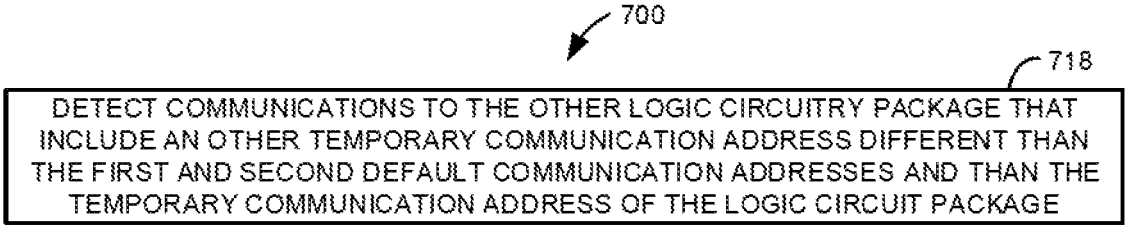

In some examples, the logic circuitry package may include a second temporary communication address, and, as illustrated in FIG. 9G, at 718, the logic circuit may detect communications to the other logic circuitry package that include an other temporary communication address, for example different than the first and second default communication addresses and than the temporary communication address of the logic circuit package.

Figure 9H:
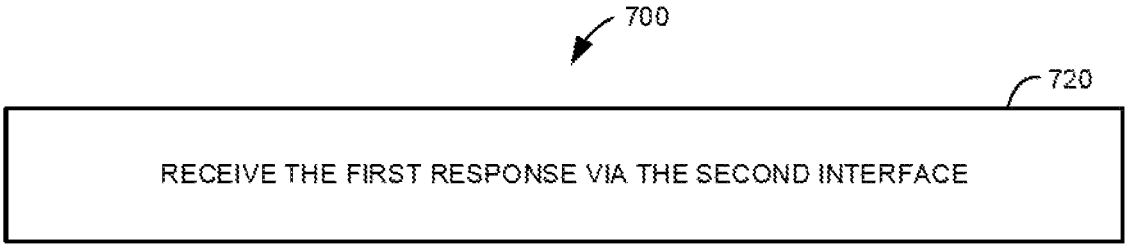

In some examples, the logic circuit may include a second interface coupled to a communication channel connected to the other logic circuitry package, and as illustrated in FIG. 9H, at 720, the logic circuit may receive the first response via the second interface.

In some examples of method 700, the communication channel is not coupled to the print apparatus logic circuit. The second interface may be an I2C interface. The second interface may be a wireless interface. The first interface may be an I2C interface.

Some examples are directed to a plurality of replaceable print apparatus components including the replaceable print apparatus component and the other replaceable print apparatus component of any of the examples described herein, wherein the other replaceable print apparatus component may include an analog sensor, and the first response may include at least one digital value based on the analog sensor. The analog sensor may be one of an ink level sensor, a pressure sensor, or a temperature sensor. The other logic circuitry package may include an I2C interface to connect to the print apparatus logic circuit via a serial bus, and an other logic circuit and another interface to communicate with the logic circuitry package over a communication channel other than the serial bus. The replaceable print apparatus component may not include any analog sensors.

Figure 10:
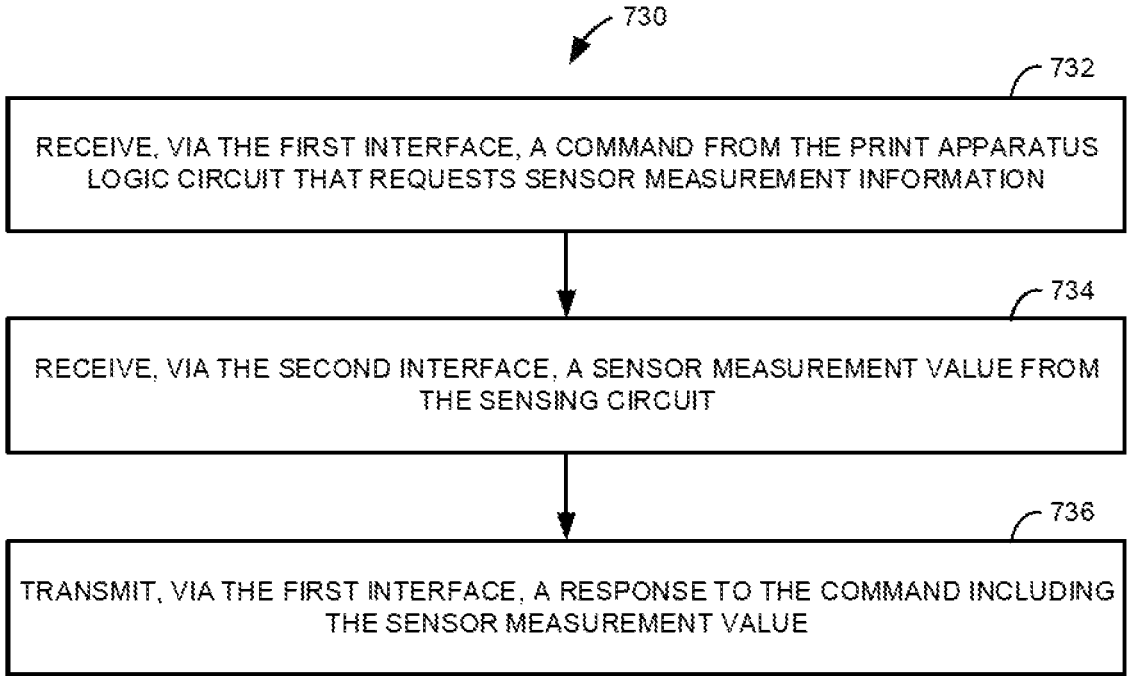
FIG. 10 is a flow diagram illustrating another example of a method that may be carried out by a logic circuitry package.

FIG. 10 is a flow diagram illustrating another example of a method 730 that may be carried out by a logic circuitry package, such as logic circuitry package 400*a*-400*d*, or by circuitry 424, 620, or 640. Method 730 may be carried out by a replaceable print apparatus component that includes a logic circuitry package. The logic circuitry package may include a first interface coupled to at least one other replaceable print apparatus component and coupled to a print apparatus logic circuit; a second interface coupled to the at least one other replaceable print apparatus component and coupled to a sensing circuit; and a logic circuit. As illustrated in FIG. 10 at 732, the logic circuit of the logic circuitry package may receive, via the first interface, a command from the print apparatus logic circuit that requests sensor measurement information. At 734, the logic circuit may receive, via the second interface, a sensor measurement value from the sensing circuit. At 736, the logic circuit may transmit, via the first interface, a response to the command including the sensor measurement value.

In some examples of method 730, the second interface may be an I2C interface. The second interface may be a wireless interface. The first interface may be an I2C interface.

Figure 11:
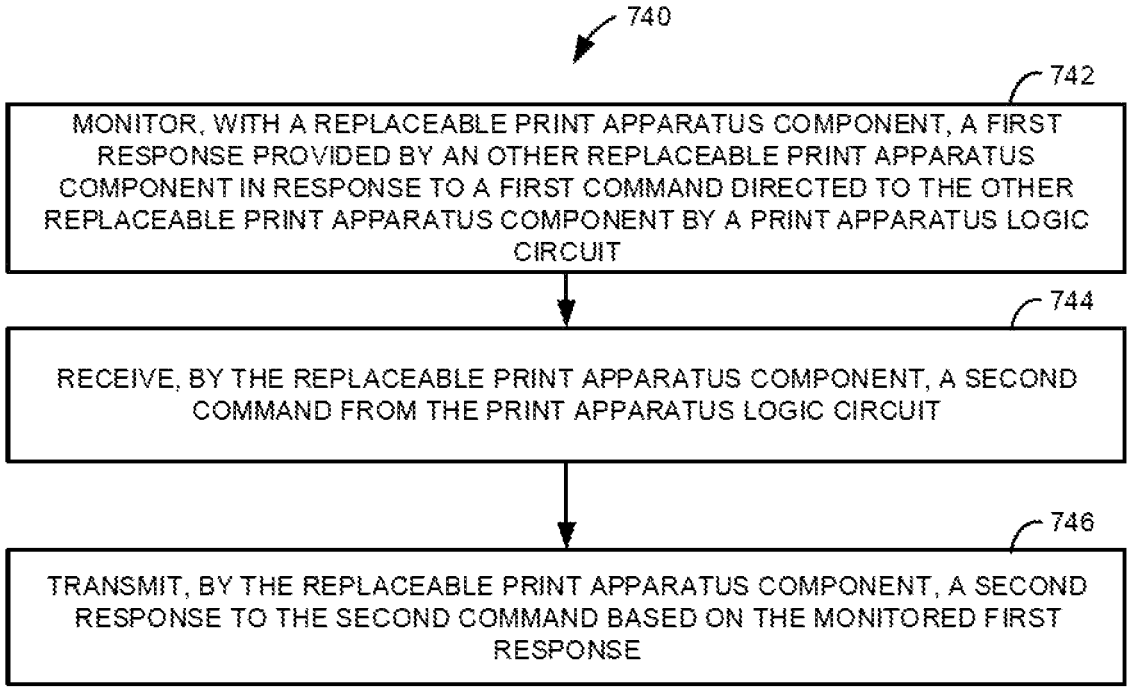
FIG. 11 is a flow diagram illustrating another example of a method that may be carried out by a logic circuitry package.

FIG. 11 is a flow diagram illustrating another example of a method 740 that may be carried out by a logic circuitry package, such as logic circuitry package 400*a*-400*d*, or by circuitry 424, 620, or 640. As illustrated in FIG. 11, at 742, method 740 includes monitoring, with a replaceable print apparatus component, a first response provided by an other replaceable print apparatus component in response to a first command directed to the other replaceable print apparatus component by a print apparatus logic circuit. At 744, method 740 includes receiving, by the replaceable print apparatus component, a second command from the print apparatus logic circuit. At 746, method 740 includes transmitting, by the replaceable print apparatus component, a second response to the second command based on the monitored first response.

In some examples of method 740, the other replaceable print apparatus component may include an analog sensor, and the first response may include sensor information from the analog sensor. The replaceable print apparatus component may not include any analog sensors.

Figure 12:
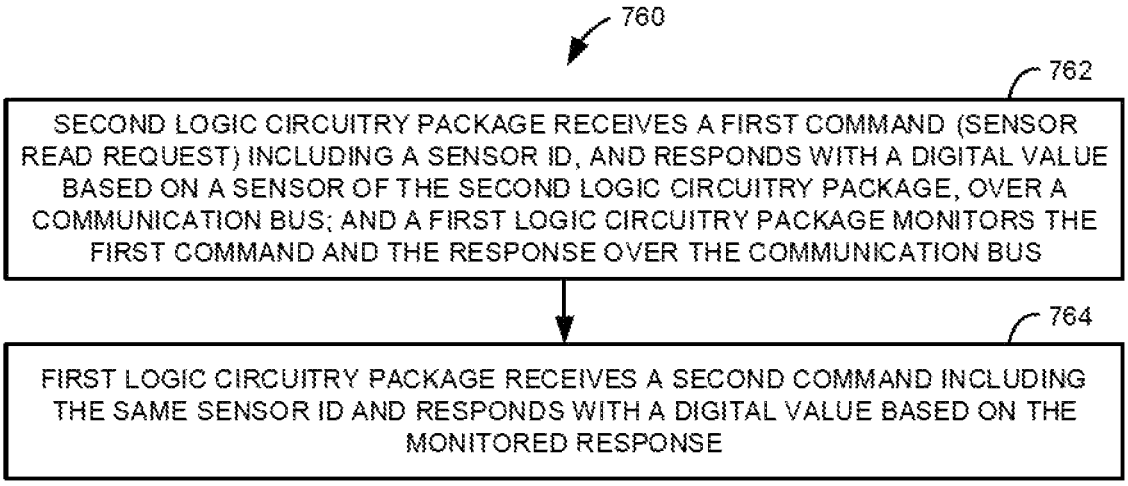
FIG. 12 is a flow diagram illustrating another example of a method that may be carried out by a logic circuitry package.

FIG. 12 is a flow diagram illustrating another example of a method 760 that may be carried out by a logic circuitry package, such as logic circuitry package 400*a*-400*d*, or by circuitry 424, 620, or 640. As illustrated in FIG. 12, at 762 in method 760, a second logic circuitry package receives a first command (e.g., a sensor read request) including a sensor ID, and responds with a digital value based on a sensor of the second logic circuitry package, over a communication bus. Also at 762, a first logic circuitry package monitors the first command and the response over the communication bus. At 764, the first logic circuitry package receives a second command including the same sensor ID and responds with a digital value based on the monitored response.

Some examples are directed to a plurality of replaceable print apparatus components installable in different receiving stations of a same print apparatus, including the replaceable print apparatus component and the other replaceable print apparatus component of any example described herein, wherein the other replaceable print apparatus component comprises at least one sensor and provides sensor information from the at least one sensor to the replaceable print apparatus component.

Some examples are directed to a replaceable print apparatus component of any of the examples described herein, which also includes a housing having a height, a width less than the height, and a length greater than the height, the height parallel to a vertical reference axis, and the width extending between two sides; a print liquid reservoir within the housing; a print liquid output; an air input above the print liquid output; and an interface comprising interface pads for communicating with a print apparatus logic circuit, the interface pads provided at an inner side of one of the sides facing a cut-out for a data interconnect to be inserted, the interface pads extending along a height direction near a top and front of the component above the air input, wherein the air input is provided at the front on the same vertical reference axis parallel to the height direction, and wherein the vertical reference axis is parallel to and distanced from an axis that intersects the interface pads.

Figure 13A:
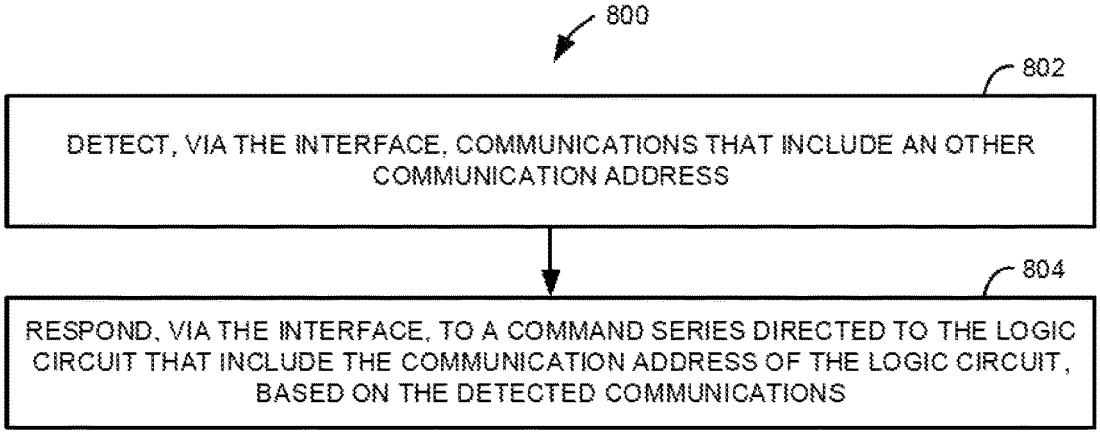
FIGS. 13A-13G are flow diagrams illustrating another example of a method that may be carried out by a logic circuitry package.

FIGS. 13A-13G are flow diagrams illustrating another example of a method 800 that may be carried out by a logic circuitry package, such as logic circuitry package 400*a*-400*d*, or by circuitry 424, 620, or 640. Method 800 may be carried out by a logic circuitry package for a replaceable print apparatus component. The logic circuitry package may include an interface to communicate with a print apparatus logic circuit, and a logic circuit having a communication address to communicate with the print apparatus logic circuit. As illustrated in FIG. 13A, at 802, the logic circuit of the logic circuitry package may detect, via the interface, communications that include an other communication address. At 804, the logic circuit may respond, via the interface, to a command series directed to the logic circuit that include the communication address of the logic circuit, based on the detected communications.

Figure 13B:
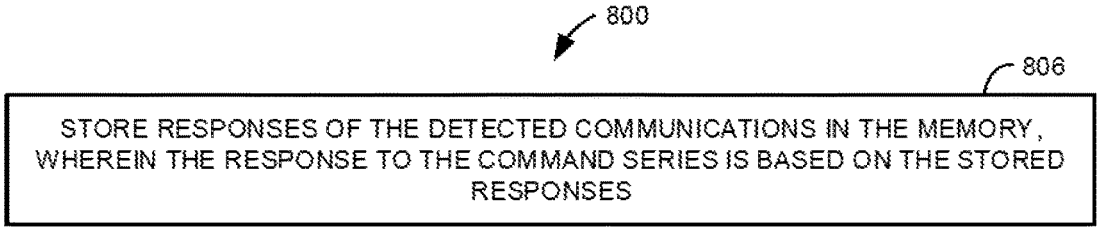

In some examples, the logic circuitry package includes a memory, and, as illustrated in FIG. 13B, at 806, the logic circuit may store responses of the detected communications in the memory, and the response to the command series may be based on the stored responses. In some examples, the logic circuit may store an approximation or condensed summary of the responses in the memory, and the response to the command series may be based on the stored approximation or condensed summary of the responses. In some examples, the other communication address is not an address of the logic circuit.

Figure 13C:
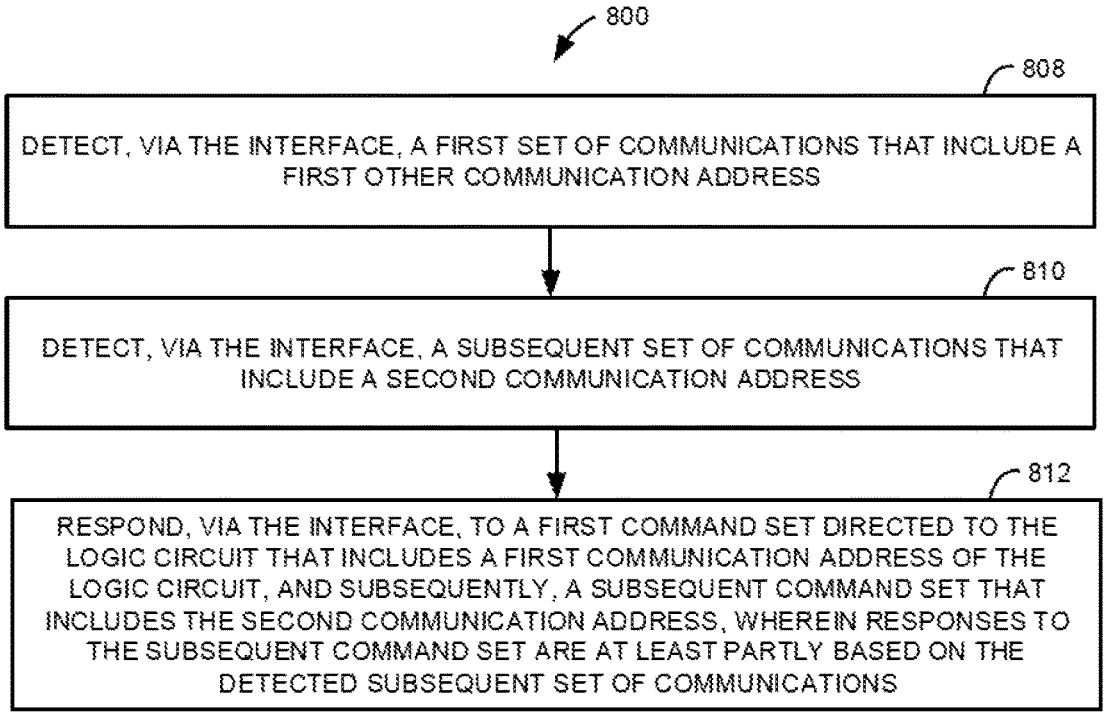

In some examples, as illustrated in FIG. 13C, at 808, the logic circuit may detect, via the interface, a first set of communications that include a first other communication address. At 810, the logic circuit may detect, via the interface, a subsequent set of communications that include a second communication address. At 812, the logic circuit may respond, via the interface, to a first command set directed to the logic circuit that includes a first communication address of the logic circuit, and subsequently, a subsequent command set that includes the second communication, wherein responses to the subsequent command set are at least partly based on the detected subsequent set of communications.

In some examples of method 800, the subsequent set of communications and the subsequent command set each include a third communication address that is a temporary address to temporarily replace the second communication address.

Figure 13D:
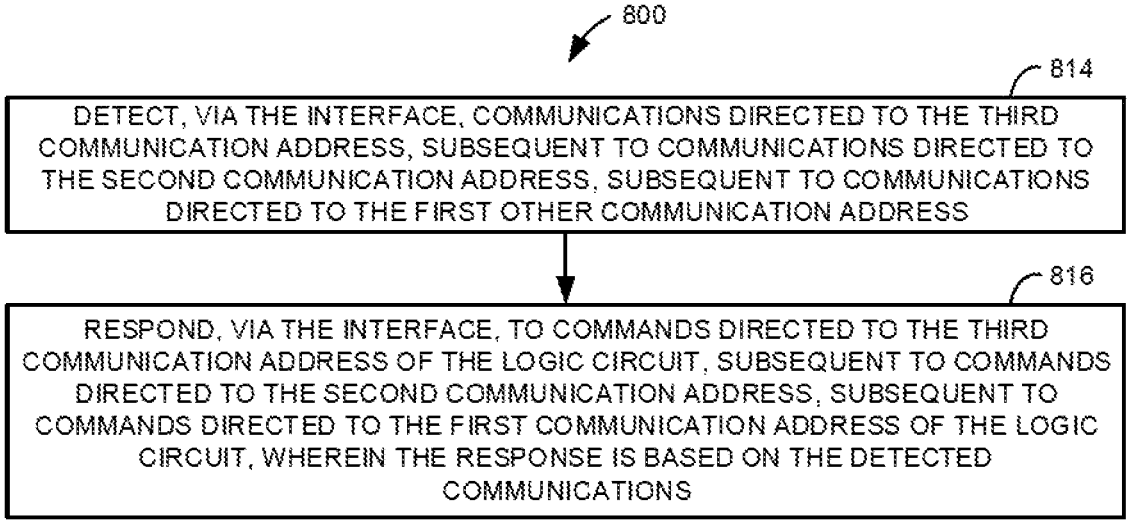

In some examples, as illustrated in FIG. 13D, at 814, the logic circuit may detect, via the interface, communications directed to the third communication address, subsequent to communications directed to the second communication address, subsequent to communications directed to the first other communication address. At 816, the logic circuit may respond, via the interface, to commands directed to the third communication address of the logic circuit, subsequent to commands directed to the second communication address, subsequent to commands directed to the first communication address of the logic circuit, wherein the response is based on the detected communications.

In some examples of method 800, the communications and the commands may include a time parameter that indicates a time period for responding to commands directed to the second communication address, and subsequently, the third communication address.

Figure 13E:
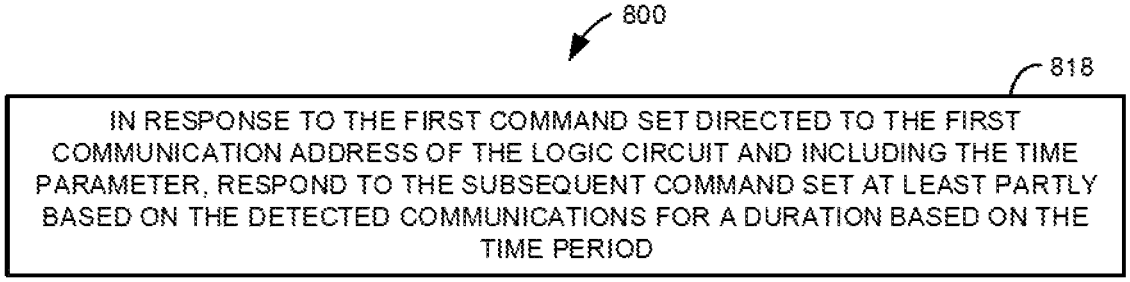

In some examples, as illustrated in FIG. 13E, at 818, the logic circuit may, in response to the first command set directed to the first communication address of the logic circuit and including the time parameter, respond to the subsequent command set at least partly based on the detected communications for a duration based on the time period.

Figure 13F:
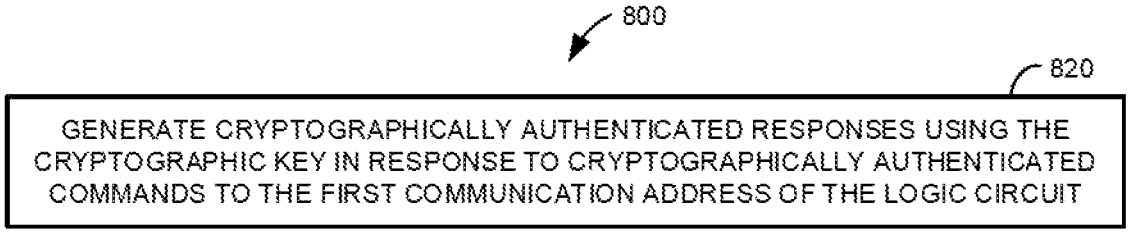

In some examples of method 800, the first set of communications may be cryptographically authenticated using a cryptographic key. In some examples, the logic circuitry package may include a memory storing the cryptographic key, and, as illustrated in FIG. 13F, at 820, the logic circuit may generate cryptographically authenticated responses using the cryptographic key in response to cryptographically authenticated commands to the first communication address of the logic circuit.

In some examples, the subsequent set of communications, including commands and responses, may not be cryptographically authenticated using the cryptographic key.

Figure 13G:
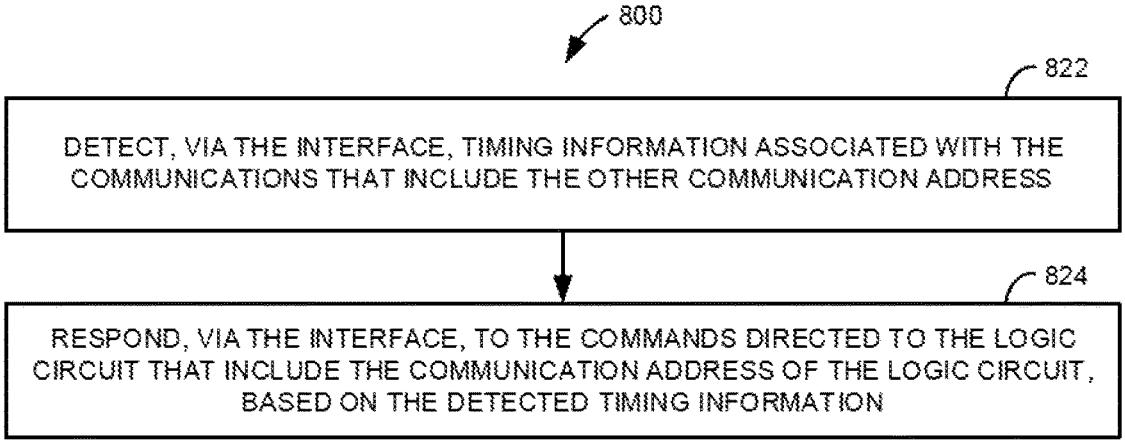

In some examples, as illustrated in FIG. 13G, at 822, the logic circuit may detect, via the interface, timing information associated with the communications that include the other communication address. At 824, the logic circuit may respond, via the interface, to the commands directed to the logic circuit that include the communication address of the logic circuit, based on the detected timing information.

In some examples of method 800, a response to commands directed to the logic circuit may include a response that copies a value specified in the detected communications. A response to commands directed to the logic circuit may include a response that includes a modified version of a value specified in the detected communications. A response to commands directed to the logic circuit may include a response that includes a pre-stored response value.

In some examples of method 800, the logic circuit is configured to respond to commands including sensor IDs with digital count values based on the detected communications. In some examples, the interface may be a serial bus interface. In some examples, the interface may be an I2C serial bus interface.

Some examples are directed to a plurality of logic circuitry packages including at least one logic circuitry package of any of the examples described herein, wherein the logic circuit is configured to monitor a predetermined communication address of at least one other logic circuitry package of the plurality of logic circuitry packages.

Some examples are directed to a logic circuitry package, which includes an I2C interface, and a logic circuit, configured to have a first default communication address, a second default communication address, and a third, temporary communication address, configured to: monitor, via the I2C interface, communications that include a communication address other than the communication address of the logic circuit; and respond, via the I2C interface, to commands directed to the at least one of the communication addresses, based on at least a portion of the monitored communications.

In some examples, the logic circuit may monitor at least one of: a command directed to another default communication address, and including a time period; a command directed to the second default communication address and including a first reconfigured address; commands directed to the first reconfigured address; and responses to the commands directed to the first reconfigured address. In some examples, the logic circuitry package may include a memory, and the logic circuit may at least temporarily store at least part of the responses to the commands directed to the first reconfigured address. The logic circuit may output, in response to a command directed to its default communication address, and including a time period; a command directed to the second communication address and including a second reconfigured address; commands directed to the second reconfigured address; responses based on the responses to commands directed to the first reconfigured address.

Some examples are directed to a replaceable print apparatus component that includes a logic circuitry package of any of the examples described herein. The replaceable print apparatus component may include a housing having a height, a width less than the height, and a length greater than the height, the height parallel to a vertical reference axis, and the width extending between two sides; a print liquid reservoir within the housing; and a print liquid output. In some examples, the replaceable print apparatus component may further include an air input above the print liquid output; and an interface comprising interface pads for communicating with a print apparatus logic circuit, the interface pads provided at an inner side of one of the sides facing a cut-out for a data interconnect to be inserted, the interface pads extending along a height direction near a top and front of the component above the air input, wherein the air input is provided at the front on the same vertical reference axis parallel to the height direction, and wherein the vertical reference axis is parallel to and distanced from an axis that intersects the interface pads.

Some examples are directed to a replaceable print apparatus component, which includes an I2C interface, and a logic circuit having at least one communication address. The logic circuit may be configured to: monitor, via the I2C interface, communications that include a communication address other than the at least one communication address of the logic circuit; and output, via the I2C interface, responses to commands directed to at least one of the at least one communication addresses of the logic circuit, based on at least a portion of the monitored communications.

Figure 14A:
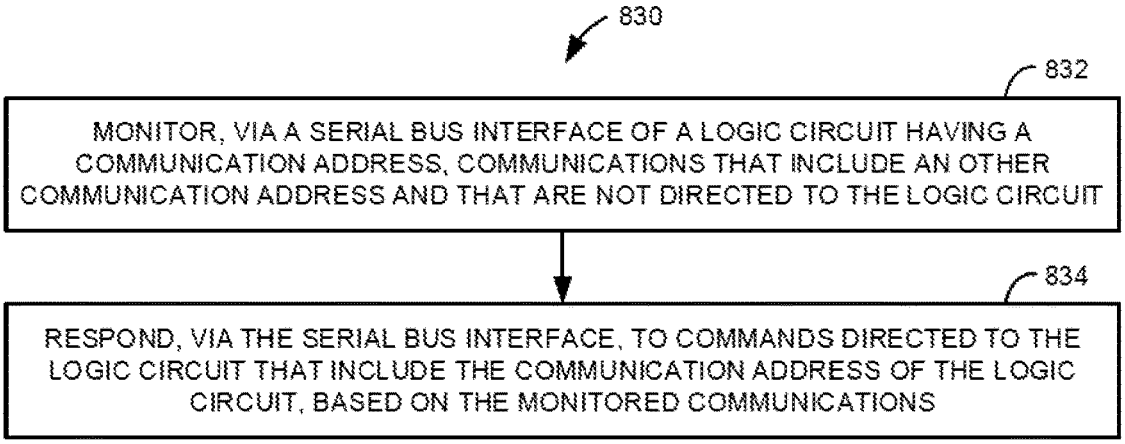
FIGS. 14A-14B are flow diagrams illustrating another example of a method that may be carried out by a logic circuitry package.
Figure 14B:
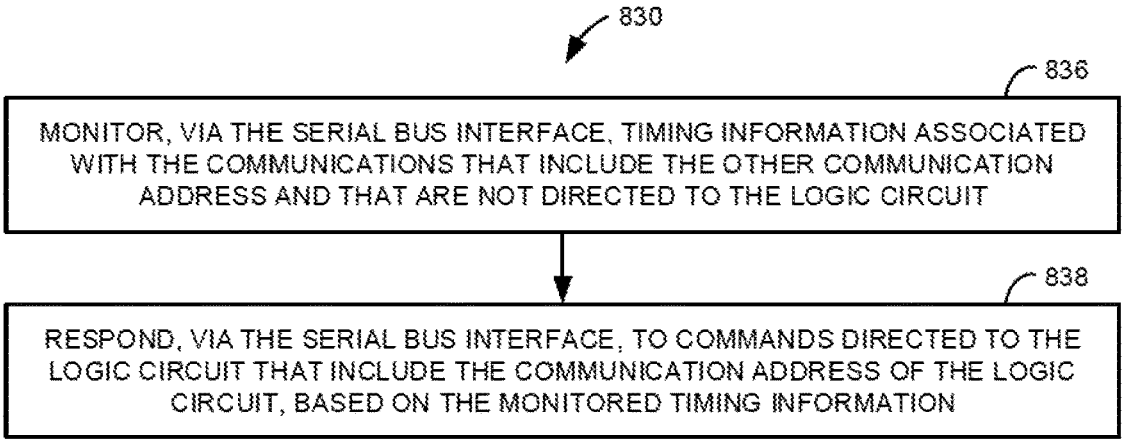

FIGS. 14A-14B are flow diagrams illustrating another example of a method 830 that may be carried out by a logic circuitry package, such as logic circuitry package 400*a*-400*d*, or by circuitry 424, 620, or 640. In some examples, as illustrated in FIG. 14A, at 832, method 830 includes monitoring, via a serial bus interface of a logic circuit having a communication address, communications that include an other communication address and that are not directed to the logic circuit. At 834, method 830 includes responding, via the serial bus interface, to commands directed to the logic circuit that include the communication address of the logic circuit, based on the monitored communications.

In some examples, as illustrated in FIG. 14B, at 836, the method 830 may include monitoring, via the serial bus interface, timing information associated with the communications that include the other communication address and that are not directed to the logic circuit. At 838, the method 830 may include responding, via the serial bus interface, to commands directed to the logic circuit that include the communication address of the logic circuit, based on the monitored timing information.

In some examples of method 830, the response to commands directed to the logic circuit may include a response that copies a value specified in the monitored communications, or may include a modified version of a value specified in the monitored communications.

Figure 15:
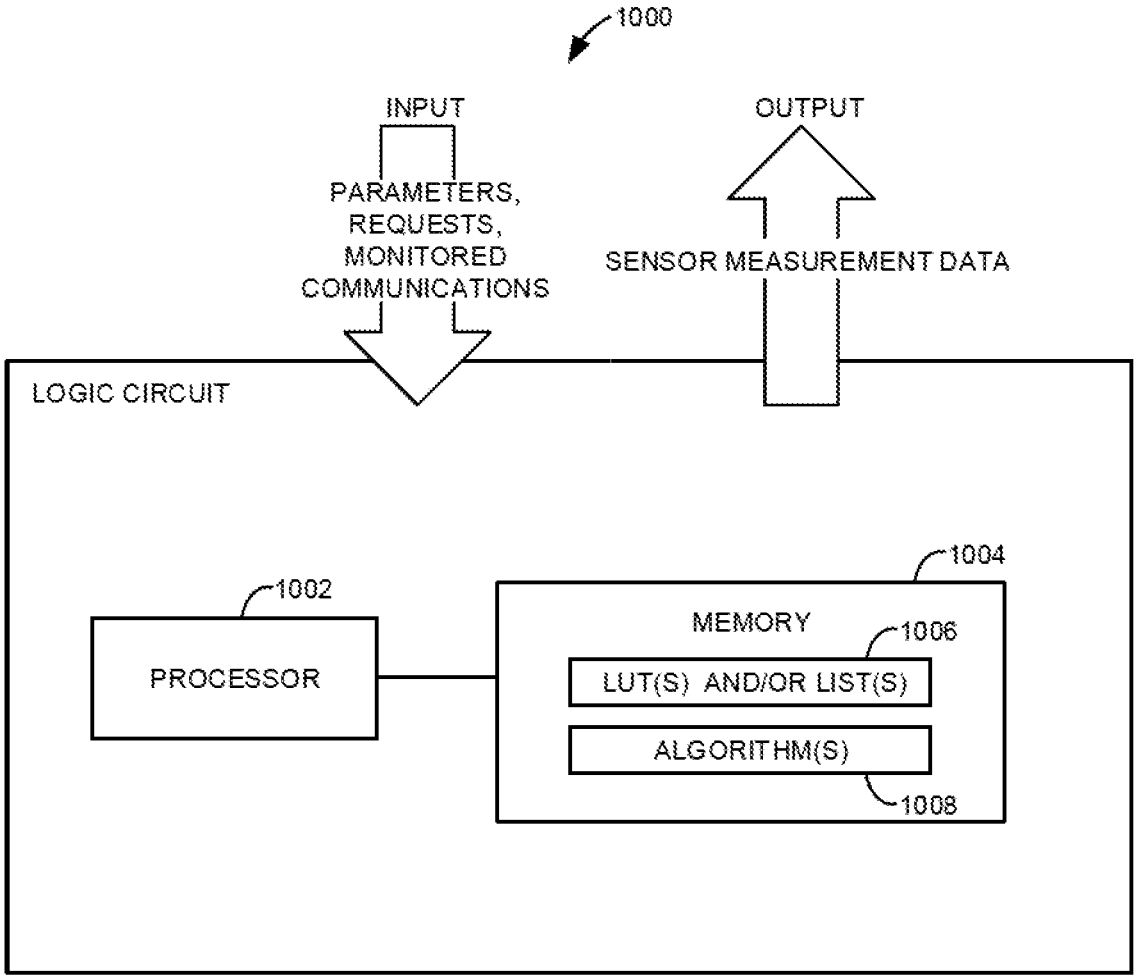
FIG. 15 illustrates another example of a logic circuitry package.

FIG. 15 illustrates another example of a logic circuitry package 1000. FIG. 15 illustrates how the logic circuitry package 1000 may generate a digital output (e.g., sensor measurement data) based on inputs including parameters and/or requests (e.g., to request sensor measurements; sensor IDs; etc.), and monitored communications, sent digitally by a print apparatus or another replaceable print apparatus component. Logic circuitry package 1000 includes a logic circuit with a processor 1002 communicatively coupled to a memory 1004. Memory 1004 may store look up table(s) and/or list(s) 1006 and/or algorithm(s) 1008. Logic circuitry package 1000 may also include any of the features of logic circuitry packages 400*a*-400*d* or circuitry 424, 620, and/or 640 as previously described.

The logic circuitry package 1000 may consult monitored communications, in combination with the LUT(s)/list(s) 1006 and/or algorithm(s) 1008, to generate the digital output. The monitored communications may include communications related to a sensor to detect an effect of a pneumatic actuation of the print apparatus upon the replaceable print component, and/or a sensor to detect an approximate temperature, and/or other sensors. The logic circuitry package 1000 may monitor communications involving a plurality of sensors of different types, for example, at least two sensors of different types, and may output digital values based on the monitored communications.

The output values may be generated using the LUT(s) and or list(s) 1006 and/or algorithm(s) 1008 whereby the requests, parameters, and monitored communications may be used as input.

The example logic circuitry package 1000 may be used as an alternative to the complex thin film sensor arrays addressed elsewhere in this disclosure. The example logic circuitry package 1000 may be configured to generate outputs that are validated by the same print apparatus logic circuit designed to be compatible with the complex sensor array packages. The alternative package 1000 may be cheaper or simpler to manufacture, or simply be used as an alternative to the earlier mentioned packages, for example to facilitate printing and validation by the print apparatus.

Logic circuitry package 1000 may be implemented in a replaceable print apparatus component and may be configured to monitor communications between a print apparatus logic circuit and an other replaceable print apparatus component. When the logic circuitry package 1000 receives a request from the print apparatus logic circuit to provide sensor information, the logic circuitry package 1000 may use the monitored communications to respond with the same response or a similar response as the other replaceable print apparatus component.

Logic circuitry package 1000 may monitor an I2C bus for commands directed to I2C addresses other than its own address, as well as responses to those commands. In response to commands directed to the I2C address of the logic circuitry package 1000, the package 1000 may mimic previously monitored responses, or provide a pre-stored response sequence upon detecting a specific command. The logic circuitry package 1000 may also monitor the timing of responses from other components, and repeat that timing in responses provided by the logic circuitry package 1000.

In one example, the logic circuitry packages described herein mainly include hardwired routings, connections, and interfaces between different components. In another example, the logic circuitry packages may also include at least one wireless connection, wireless communication path, or wireless interface, for internal and/or external signaling, whereby a wirelessly connected element may be considered as included in the logic circuitry package and/or replaceable component. For example, certain sensors may be wireless connected to communicate wirelessly to the logic circuit/sensor circuit. For example, sensors such as pressure sensors and/or print material level sensors may communicate wirelessly with other portions of the logic circuit. These elements, which communicate wirelessly with the rest of the logic circuit, may be considered part of the logic circuit or logic circuitry package. Also, the external interface of the logic circuitry package, to communicate with the print apparatus logic circuit, may include a wireless interface. Also, while reference may be made to power routings, power interfaces, or charging or powering certain cells, certain examples of this disclosure may include a power source such as a battery or a power harvesting source that may harvest power from data or clock signals.

Certain example circuits of this disclosure relate to outputs that vary in a certain way in response to certain commands, events and/or states. It is also explained that, unless calibrated in advance, responses to these same events and/or states may be "clipped", for example so that they cannot be characterized or are not relatable to these commands, events and/or states. For these example circuits where the output needs to be calibrated to obtain the characterizable or relatable output, it should be understood that also before required calibration (or installation)

occurred these circuits are in fact already "configured" to provide for the characterizable output, that is, all means are present to provide for the characterizable output, even where calibration is yet to occur. It may be a matter of choice to calibrate a logic circuit during manufacture and/or during customer installation and/or during printing, but this does not take away that the same circuit is already "configured" to function in the calibrated state. For example, when sensors are mounted to a reservoir wall, certain strains in that wall over the lifetime of the component may vary and may be difficult to predict while at the same time these unpredictable strains affect the output of the logic circuit. Different other circumstances such as conductivity of the print material, different packaging, in-assembly-line-mounting, etc. may also influence how the logic circuit responds to commands/events/states so that a choice may be made to calibrate at or after a first customer installation. In any of these and other examples, it is advantageous to determine (operational) calibration parameters in-situ, after first customer installation and/or between print jobs, whereby, again, these should be considered as already adapted to function in a calibrated state. Certain alternative (at least partly) "virtual" embodiments discussed in this disclosure may operate with LUTs or algorithms, which may similarly generate, before calibration or installation, clipped values, and after calibration or installation, characterizable values whereby such alternative embodiment, should also be considered as already configured or adapted to provide for the characterizable output, even before calibration/installation.

In one example, the logic circuitry package outputs count values in response to read requests. In many examples, the output of count values is discussed. In certain examples, each separate count value is output in response to each read request. In another example, a logic circuit is configured to output a series or plurality of count values in response to a single read request. In other examples, output may be generated without a read request.

Each of the logic circuitry packages 400*a*-400*d*, 1000 described herein may have any feature of any other logic circuitry packages 400*a*-400*d*, 1000 described herein or of the circuitry 424, 620, 640. Any logic circuitry packages 400*a*-400*d*, 1000 or the circuitry 424, 620, 640 may be configured to carry out at least one method block of the methods described herein. Any first logic circuit may have any attribute of any second logic circuit, and vice versa.

Examples in the present disclosure can be provided as methods, systems or machine readable instructions, such as any combination of software, hardware, firmware or the like. Such machine readable instructions may be included on a machine readable storage medium (including but not limited to disc storage, CD-ROM, optical storage, etc.) having machine readable program codes therein or thereon.

The present disclosure is described with reference to flow charts and block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that at least some blocks in the flow charts and block diagrams, as well as combinations thereof can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing circuitry may execute the machine readable instructions. Thus, functional modules of the apparatus and devices (for example, logic circuitry and/or controllers) may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a machine readable storage (e.g., a tangible machine readable medium) that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by block(s) in the flow charts and/or in the block diagrams.

Further, the teachings herein may be implemented in the form of a computer software product, the computer software product being stored in a storage medium and comprising a plurality of instructions for making a computer device implement the methods recited in the examples of the present disclosure.

The word "comprising" does not exclude the presence of elements other than those listed in a claim, "a" or "an" does not exclude a plurality, and a single processor or other unit may fulfil the functions of several units recited in the claims.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A logic circuitry package for a replaceable print apparatus component comprising an interface to communicate with a print apparatus logic circuit, and a logic circuit having a communication address to communicate with the print apparatus logic circuit, the logic circuit configured to:

detect, via the interface, communications that include an other communication address; and respond, via the interface, to a command series directed to the logic circuit that include the communication address of the logic circuit, based on the detected communications, wherein a response to commands directed to the logic circuit includes a response that copies a value specified in the detected communications.

2. The logic circuitry package of claim 1, and further comprising a memory, and wherein the logic circuit is configured to:

store responses of the detected communications in the memory, wherein the response to the command series is based on the stored responses.

3. The logic circuitry package of claim 1, wherein the other communication address is not an address of the logic circuit.

4. The logic circuitry package of claim 1, wherein the logic circuit is configured to:

detect, via the interface, a first set of communications that include a first other communication address;

detect, via the interface, a subsequent set of communications that include a second communication address; and respond, via the interface, to a first command set directed to the logic circuit that includes a first communication address of the logic circuit, and subsequently, a subsequent command set that includes the second communication address, wherein responses to the subsequent command set are at least partly based on the detected subsequent set of communications.

5. The logic circuitry package of claim 4, wherein the subsequent set of communications and the subsequent command set each include a third communication address that is a temporary address to temporarily replace the second communication address.

6. The logic circuitry package of claim 5, wherein the logic circuit is configured to:

detect, via the interface, communications directed to the third communication address, subsequent to communications directed to the second communication address, subsequent to communications directed to the first other communication address; and respond, via the interface, to commands directed to the third communication address of the logic circuit, subsequent to commands directed to the second communication address, subsequent to commands directed to the first communication address of the logic circuit, wherein the response is based on the detected communications.

7. The logic circuitry package of claim 4, wherein the communications and the commands include a time parameter that indicates a time period for responding to commands directed to the second communication address, and subsequently, the third communication address.

8. The logic circuitry package of claim 7, wherein the logic circuit is configured to:

in response to the first command set directed to the first communication address of the logic circuit and including the time parameter, respond to the subsequent command set at least partly based on the detected communications for a duration based on the time period.

9. The logic circuitry package of claim 4, wherein the first set of communications are cryptographically authenticated using a cryptographic key.

10. The logic circuitry package of claim 9, and further comprising a memory storing the cryptographic key, and wherein the logic circuit is configured to:

generate cryptographically authenticated responses using the cryptographic key in response to cryptographically authenticated commands to the first communication address of the logic circuit.

11. The logic circuitry package of claim 9, wherein the subsequent set of communications, including commands and responses, are not cryptographically authenticated using the cryptographic key.

12. The logic circuitry package of claim 1, wherein the logic circuit is configured to:

detect, via the interface, timing information associated with the communications that include the other communication address; and respond, via the interface, to the commands directed to the logic circuit that include the communication address of the logic circuit, based on the detected timing information.

13. The logic circuitry package of claim 1, wherein a response to commands directed to the logic circuit includes a response that includes a modified version of a value specified in the detected communications.

14. The logic circuitry package of claim 1, wherein a response to commands directed to the logic circuit includes a response that includes a pre-stored response value.

15. The logic circuitry package of claim 1, wherein the logic circuit is configured to respond to commands including sensor IDs with digital count values based on the detected communications.

16. The logic circuitry package of claim 1, wherein the interface is a serial bus interface.

17. The logic circuitry package of claim 1, wherein the interface is an I2C serial bus interface.

18. A logic circuitry package including a logic circuit having at least one communication address, wherein the at least one communication address includes a first default communication address, a second default communication address, and a third, temporary communication address, wherein the logic circuit is configured to:

monitor, via the I2C interface, communications that include a communication address other than the communication addresses of the logic circuit; and respond, via the I2C interface, to commands directed to at least one of the communication addresses, based on at least a portion of the monitored communications.

19. The logic circuitry package of claim 18, wherein the logic circuit is configured to monitor at least one of:

a command directed to another default communication address, and including a time period;

a command directed to the second default communication address and including a first reconfigured address;

commands directed to the first reconfigured address; and responses to the commands directed to the first reconfigured address.

20. The logic circuitry package of claim 19, further comprising a memory, and wherein the logic circuit is configured to at least temporarily store at least part of the responses to the commands directed to the first reconfigured address.

21. The logic circuitry package of claim 19, wherein the logic circuit is configured to output, in response to a command directed to its default communication address, and including a time period;

a command directed to the second communication address and including a second reconfigured address;

commands directed to the second reconfigured address;

responses based on the responses to commands directed to the first reconfigured address.

22. A replaceable print apparatus component, comprising:

an I2C interface;

a logic circuit, having at least one communication address, and configured to:

monitor, via the I2C interface, communications that include a communication address other than the at least one communication address of the logic circuit, wherein the communication address other than the at least one communication address of the logic circuit is not an address of the logic circuit; and output, via the I2C interface, responses to commands directed to at least one of the at least one communication addresses of the logic circuit, based on at least a portion of the monitored communications.

23. The replaceable print apparatus component of claim 22, wherein the at least one communication address includes a first default communication address, a second default communication address, and a third, temporary communication address.

* * * * *